US007665354B2

(12) United States Patent
Shammai

(10) Patent No.: US 7,665,354 B2
(45) Date of Patent: Feb. 23, 2010

(54) METHOD AND APPARATUS FOR AN OPTIMAL PUMPING RATE BASED ON A DOWNHOLE DEW POINT PRESSURE DETERMINATION

(75) Inventor: Michael Shammai, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 302 days.

(21) Appl. No.: 11/754,747

(22) Filed: May 29, 2007

(65) Prior Publication Data

US 2007/0214877 A1 Sep. 20, 2007

Related U.S. Application Data

(63) Continuation of application No. 10/851,793, filed on May 21, 2004, now Pat. No. 7,222,524.

(60) Provisional application No. 60/472,358, filed on May 21, 2003.

(51) Int. Cl.
*E21B 49/10* (2006.01)

(52) U.S. Cl. ..... 73/152.24

(58) Field of Classification Search ..... None
See application file for complete search history.

(56) References Cited

U.S. PATENT DOCUMENTS 3,756,720 A 9/1973 Skala
3,890,046 A 6/1975 Hart et al.
4,583,595 A 4/1986 Czernichow et al.
4,721,157 A 1/1988 Berzin
4,766,955 A 8/1988 Pertermann
4,903,765 A 2/1990 Zunkel (Continued)

FOREIGN PATENT DOCUMENTS

EP 0461321 12/1991

(Continued)

*Primary Examiner*—Robert R Raevis
(74) *Attorney, Agent, or Firm*—Mossman, Kumar & Tyler PC

(57) ABSTRACT

The present invention provides a downhole spectrometer for determination of dew point pressure to determine an associated optimal pumping rate during sampling to avoid precipitation of asphaltenes in a formation sample. A sample is captured at formation pressure in a controlled volume. The pressure in the controlled volume is reduced. Initially the formation fluid sample appears dark and allows less light energy to pass through a sample under test. The sample under test, however, becomes lighter and allows more light energy to pass through the sample as the pressure is reduced and the formation fluid sample becomes thinner or less dense under the reduced pressure. At the dew point pressure, however, the sample begins to darken and allows less light energy to pass through it as asphaltenes begin to precipitate out of the sample. Thus, the dew point is that pressure at which peak light energy passes through the sample. The dew point pressure is plugged into an equation to determine the optimum pumping rate for a known mobility, during sampling to avoid dropping the pressure down to the dew point pressure to avoid asphaltene precipitation or dew forming in the sample. The bubble point can be plugged into an equation to determine the optimum pumping rate for a known mobility, during sampling to avoid dropping the pressure down to the bubble point pressure to avoid bubbles forming in the sample.

8 Claims, 25 Drawing Sheets

U.S. PATENT DOCUMENTS

| | | | |
|---|---|---|---|
| 5,009,100 | A | 4/1991 | Gruber et al. |
| 5,240,072 | A | 8/1993 | Schultz et al. |
| 5,303,775 | A | 4/1994 | Michaels et al. |
| 5,322,120 | A | 6/1994 | Boe et al. |
| 5,329,811 | A | 7/1994 | Schultz et al. |
| 5,337,822 | A | 8/1994 | Massie et al. |
| 5,361,839 | A | 11/1994 | Griffith et al. |
| 5,377,755 | A | 1/1995 | Michaels et al. |
| 5,635,631 | A | 6/1997 | Yesudas et al. |
| 5,662,166 | A | 9/1997 | Shammai |
| 6,467,544 | B1 | 10/2002 | Brown et al. |

FOREIGN PATENT DOCUMENTS

| | | |
|---|---|---|
| GB | 2377952 | 1/2003 |

| DEW POINT EXPERIMENT DATA SUMMARY | | | | | | |
|---|---|---|---|---|---|---|
| EXPERIMENT | TEMP (°C) | STARTING PRESSURE (PSI) | ENDING PRESSURE (PSI) | RATE (cc/min) | DEW POINT NIR (PSI) | DEW POINT VISUAL (PSI) |
| A | 120 | 12,000 | 2,000 | 5 | 6000 | 6000 |
| B | 120 | 12000 | 2500 | 3 | 7500 | 7650 |
| C | 120 | 12000 | 2500 | 5 | 800 | 8200 |
| D | 120 | 12000 | 2500 | 7 | 5500 | 8500 |
| E | 120 | 12000 | 2500 | 7 | 9500 | 10,000 |
| F | 120 | 12000 | 2500 | 3 | 9500 | 9300 |
| G | 120 | 12000 | 2500 | 3 | 9500 | 9300 |
| H | 120 | 12000 | 2500 | 7 | 9500 | 9300 |
| I | 120 | 12000 | 2500 | 14 | 9500 | 9500 |

400
410
420
440
DEW POINT @ 9,500 PSI
NIR
Power (watts)
1.40E-04
1.20E-04
1.00E-04
8.00E-05
6.00E-05
4.00E-05
2.00E-05
0.00E+00
Pressure (psi)
0
100
200
300
400
500
600
700
800
900
1000
1100
1200
1300
1500
1500
1500

METHOD AND APPARATUS FOR AN OPTIMAL PUMPING RATE BASED ON A DOWNHOLE DEW POINT PRESSURE DETERMINATION

CROSS REFERENCE TO RELATED APPLICATIONS

This patent application is a continuation of U.S. patent application Ser. No. 10/851,793 filed May 21, 2004 which claims priority from U.S. provisional patent application No. 60/472,358 filed on May 21, 2003.

BACKGROUND OF THE INVENTION

1. Field of the Invention

The invention relates to spectrometry in a downhole well bore environment and specifically, it pertains to a robust apparatus and method for determining an optimal pumping rate based on a in situ downhole dew point pressure or bubble point pressure either known or determined by measuring light spectra for electromagnetic absorbance for a formation fluid sample while decreasing the pressure on the sample under test.

2. Summary of the Related Art

Earth formation fluids present in a hydrocarbon producing well typically comprise a mixture of oil, gas, and water. The pressure, temperature and volume of formation fluids control the phase relation of these constituents. In a subsurface formation, high well fluid pressures often entrain gases within the oil above the bubble point pressure. When the pressure is reduced, the entrained or dissolved gaseous compounds separate from the liquid phase sample. The accurate measure of pressure, temperature, and formation fluid composition from a particular well affects the commercial interest in producing fluids available from the well. The data also provides information regarding procedures for maximizing the completion and production of the respective hydrocarbon reservoir.

Certain techniques analyze the well fluids downhole in the well bore. U.S. Pat. No. 6,467,544 to Brown, et al. describes a sample chamber having a slidably disposed piston to define a sample cavity on one side of the piston and a buffer cavity on the other side of the piston. U.S. Pat. No. 5,361,839 to Griffith et al. (1993) disclosed a transducer for generating an output representative of fluid sample characteristics downhole in a wellbore. U.S. Pat. No. 5,329,811 to Schultz et al. (1994) disclosed an apparatus and method for assessing pressure and volume data for a downhole well fluid sample.

Other techniques capture a well fluid sample for retrieval to the surface. U.S. Pat. No. 4,583,595 to Czenichow et al. (1986) disclosed a piston actuated mechanism for capturing a well fluid sample. U.S. Pat. No. 4,721,157 to Berzin (1988) disclosed a shifting valve sleeve for capturing a well fluid sample in a chamber. U.S. Pat. No. 4,766,955 to Petermann (1988) disclosed a piston engaged with a control valve for capturing a well fluid sample, and U.S. Pat. No. 4,903,765 to Zunkel (1990) disclosed a time delayed well fluid sampler. U.S. Pat. No. 5,009,100 to Gruber et al. (1991) disclosed a wireline sampler for collecting a well fluid sample from a selected wellbore depth, U.S. Pat. No. 5,240,072 to Schultz et al. (1993) disclosed a multiple sample annulus pressure responsive sampler for permitting well fluid sample collection at different time and depth intervals, and U.S. Pat. No. 5,322,120 to Be et al. (1994) disclosed an electrically actuated hydraulic system for collecting well fluid samples deep in a wellbore.

Temperatures downhole in a deep wellbore often exceed 300 degrees F. When a hot formation fluid sample at 300 degrees F. is retrieved to the surface at a temperature of 70 degrees F., the resulting decrease in temperature causes the formation fluid sample to contract. If the volume of the sample is unchanged, such contraction substantially reduces the sample pressure. A pressure drop can result in changes in the situ formation fluid parameters, and can permit phase separation between liquids and gases entrained within the formation fluid sample. Phase separation significantly changes the formation fluid characteristics, and reduces the ability to evaluate the actual properties of the formation fluid.

To overcome this limitation, various techniques have been developed to maintain pressure of the formation fluid sample. U.S. Pat. No. 5,337,822 to Massie et al. (1994) pressurized a formation fluid sample with a hydraulically driven piston powered by a high-pressure gas. Similarly, U.S. Pat. No. 5,662,166 to Shammai (1997) used a pressurized gas to charge the formation fluid sample. U.S. Pat. Nos. 5,303,775 (1994) and U.S. Pat. No. 5,377,755 (1995) to Michaels et al. disclosed a bi-directional, positive displacement pump for increasing the formation fluid sample pressure above the bubble point so that subsequent cooling did not reduce the fluid pressure below the bubble point.

Existing techniques for maintaining the sample formation pressure are limited by many factors. Pretension or compression springs are not suitable because the required compression forces require extremely large springs. Shear mechanisms are inflexible and do not easily permit multiple sample gathering at different locations within the well bore. Gas charges can lead to explosive decompression of seals and sample contamination. Gas pressurization systems require complicated systems including tanks, valves and regulators which are expensive, occupy space in the narrow confines of a well bore, and require maintenance and repair. Electrical or hydraulic pumps require surface control and have similar limitations.

If during pumping a sample into a sample tank, the pressure drops below the bubble point pressure or dew point pressure, nucleation of gas bubbles, precipitation of solids, and hydrocarbon loss respectively changes the single-phase liquid crude sample into a two-phase or three phase state consisting of liquid and gas or liquid and solids. Single phase samples which represent the native state of the formation fluid are sought for analysis of the formation in downhole conditions. Two-phase samples are undesirable, because once the crude oil sample has separated into two phases, it can be difficult or impossible and take a long time (weeks), if ever, to return the sample to its initial single-phase liquid state even after reheating and/or shaking the sample to induce returning it to a single-phase state.

Due to the uncertainty of the restoration process, any pressure-volume-temperature (PVT) lab analyses that are performed on the restored single-phase crude oil are of suspect quality and consistency. Thus there is a need for a process for determining the dew point for a formation sample so that an optimal pumping rate can be selected while sampling to ensure that the pressure does not drop below the dew point or bubble point pressure during sampling and risk sample spoilage.

SUMMARY OF THE INVENTION

The present invention addresses the shortcomings of the related art described above. The present invention avoids precipitation of solids and nucleation of bubbles during sampling, thus maintaining a single phase sample. The present invention provides method and apparatus for determining an optimal pumping rate so that a sample does not undergo a pressure drop during sample acquisition that would drop the sample pressure below the dew point. A downhole spectrometer is provided for determination of dew point pressure to determine an optimal pumping rate during sampling to avoid phase change in a formation sample. A hydrocarbon sample (gas) is captured at formation pressure in a controlled volume. The pressure in the controlled volume is reduced. Initially the formation fluid sample appears dark as it allows less light energy to pass through a sample under test. The sample under test, however, becomes lighter and allows more light energy to pass through the sample as the pressure is reduced and the formation fluid sample becomes thinner or less dense as the pressure decreases. At the dew point pressure, however, the sample begins to darken and allows less light energy to pass through the sample as asphaltenes begin to precipitate out of the sample. Thus, the dew point pressure is that pressure at which peak light energy passes through the sample. The dew point pressure is plugged into an equation to determine the optimum pumping rate for a known formation fluid mobility. The optimal pumping rate during sampling pumps the fluid as quickly as possible while avoiding dropping the pumping or formation sample pressure down to or below the dew point pressure. The optimal pump rate, selected to stay above the dew point pressure, thus avoids dew from forming in the sample. A similar process is performed for black oils for selecting an optimal pump rated to determine the bubble point pressure and the optimal pumping rate to stay above the bubble point pressure and also to avoid asphaltene precipitation pressure at reservoir temperature. The dew point and bubble point may be determined downhole or other wise known.

BRIEF DESCRIPTION OF THE FIGURES

For a detailed understanding of the present invention, reference should be made to the following detailed description of the exemplary embodiment, taken in conjunction with the accompanying drawings, in which like elements have been given like numerals, wherein.

DETAILED DESCRIPTION OF AN EXEMPLARY EMBODIMENT

Figure 1:
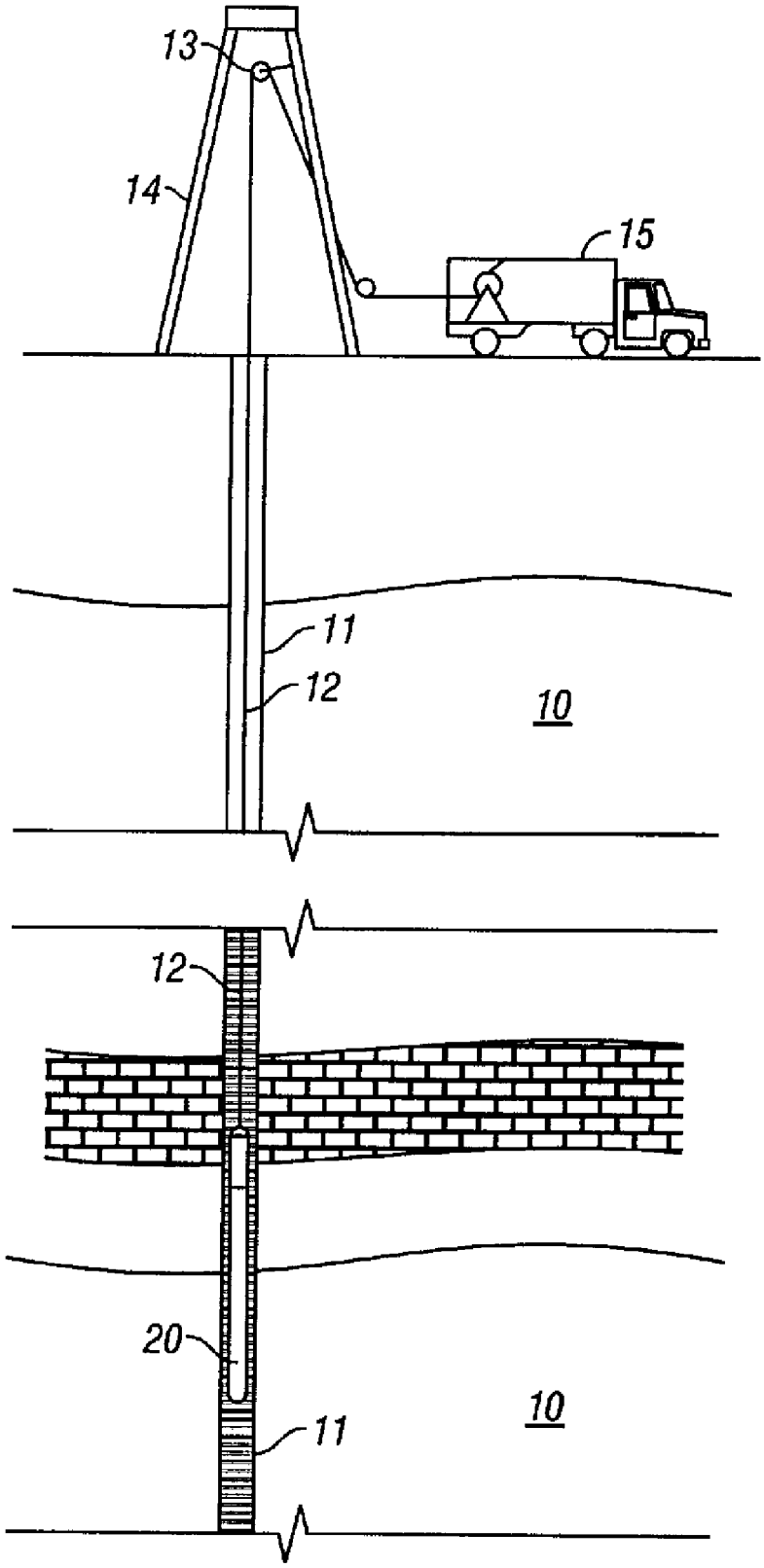
FIG. 1 is a schematic earth section illustrating the invention operating environment.

Baker Atlas provides the Reservoir Characterization Instrument™ (RCI™) to evaluate samples representative of a hydrocarbon reservoir. The RCI™ is used to measure reservoir pressure as well as collecting samples from the reservoir. The samples are processed in pressure/volume/temperature (PVT) laboratories to determine the thermodynamic properties and relationships (PVT data) which are used to infer the properties of the formation from which a sample is taken. The quality of this data is directly dependent on the quality of the sample collected by the RCI™. Some of the most difficult samples to collect are near critical hydrocarbons, retrograde gas, and wet gas. The dew point of the gas sample is a very important parameter in terms of the sample quality. If the sample is dropped below the dew point it could loose substantial amounts of liquid hydrocarbon in the reservoir or in the tool and hence severely alter its composition. One of the tools that is run in conjunction with the RCI™ is the Sample View™ which, is equipped with a near infrared source and detector. The Sample View™ tool is used to test samples of formation fluid from the reservoir fluid at downhole in situ conditions. The Sample View™ spectral scan at a wavelength of 1500 nm or other wavelengths of interest with a simultaneous volume expansion of the sample in an isolated section of the tool provides details regarding phase change such as the pressure at which the first drop of liquid appears (dew point pressure). A plot of absorbance versus pressure reveals sharp drop in absorbance at the dew point pressure.

This technology provided by the present invention enhances the sampling capability in the gas reservoirs. Currently there are no known technologies available in the oil field services market that provide dew point data at in situ conditions. During any sampling routine in the reservoir, the reservoir fluid sample is removed from its natural environment, i.e., the reservoir, and placed inside of a high-pressure chamber located in a downhole sampling tool, such as the RCI™. This occurs by pumping a sample from the formation by creating a pressure drop at the well bore interface to the formation to induce flow into the RCI™ tool sampling chamber. If the pumping rate is too fast, this sampling pumping pressure drop decreases the sample pressure below the dew point pressure. Once the sampling pumping pressure drops down so that dew point is reached, a substantial amount of liquid condensate can be lost from the reservoir sample, thereby substantially changing the composition of the sample permanently. The present example of the invention determines the in situ dew point which is used to set an optimal pump rate in the RCI™. This optimal pump rate enables the RCI™ to collect the best quality sample at shortest time possible without reaching the dew point pressure.

Single phase sampling was introduced into the oil industry to provide the best quality sample to the PVT laboratories. The PVT data is generally used to conduct the economic evaluation of the reservoir and also to design the production facilities. This technology appeared to work very well for the black oil and volatile oil, which normally exists at undersaturated conditions in the reservoir. Sampling of retrograde gas and wet gas, however, proved to be a much more difficult task. To collect these retrograde and wet gas samples in a single phase condition, it is helpful to know the dew point. Knowing the dew point is helpful even in the reservoirs where no information is available regarding the composition of the hydrocarbon. The present invention for the first time provides the industry much needed dew point data under in situ conditions while sampling a gas reservoir. By providing an in situ downhole dew point pressure the pump rate can be adjusted to avoid the two phase region of the phase envelope, that is, the region below the dew point pressure. Therefore a truly virgin sample, representative of downhole conditions can be collected under this condition.

FIG. 1 schematically represents a cross-section of earth 10 along the length of a wellbore penetration 11. Usually, the wellbore will be at least partially filled with a mixture of liquids including water, drilling fluid, and formation fluids that are indigenous to the earth formations penetrated by the wellbore. Hereinafter, such fluid mixtures are referred to as "wellbore fluids." The term "formation fluid" hereinafter refers to a specific formation fluid exclusive of any substantial mixture or contamination by fluids not naturally present in the specific formation.

Suspended within the wellbore 11 at the bottom end of a wireline 12 is a formation fluid sampling tool 20. The wireline 12 is often carried over a pulley 13 supported by a derrick 14. Wireline deployment and retrieval is performed by a powered winch carried by a surface processor, such as a service truck 15.

Figure 2:
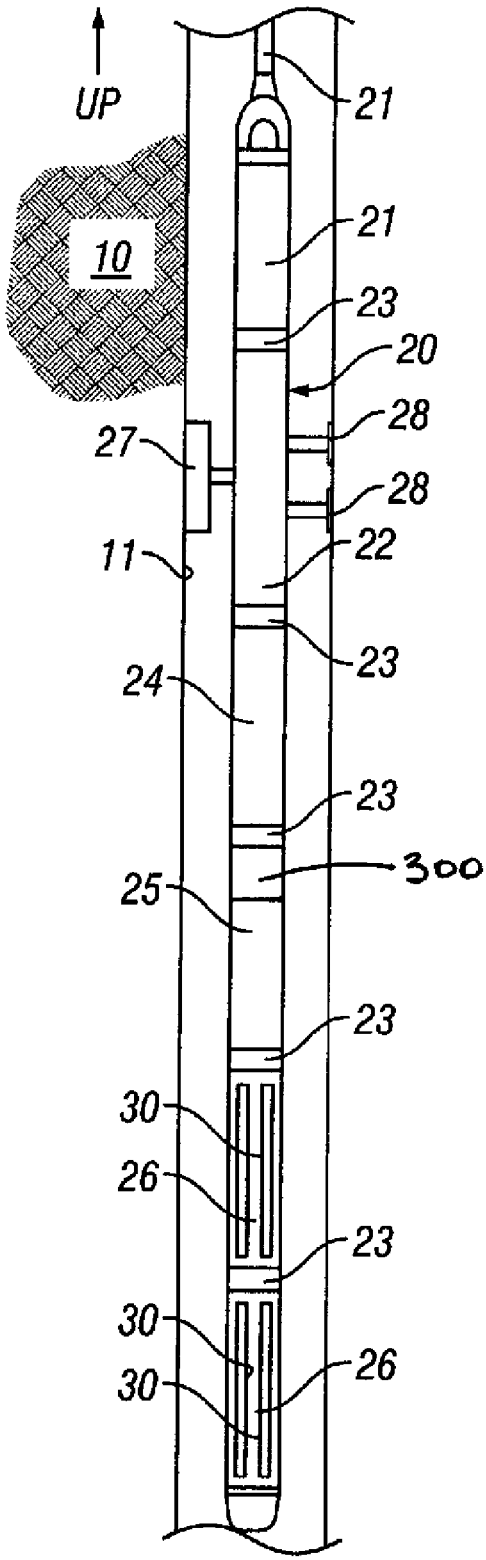
FIG. 2 is a schematic of the invention in operative assembly with cooperatively supporting tools.

Pursuant to the present invention, an exemplary embodiment of a sampling tool 20 using the present invention is schematically illustrated by FIG. 2. Preferably, such sampling tools are a serial assembly of several tool segments that are joined end-to-end by the threaded sleeves of mutual compression unions 23. An assembly of tool segments appropriate for the present invention may include a hydraulic power unit 21 and a formation fluid extractor 23. Below the extractor 23, a large displacement volume motor/pump unit 24 is provided for line purging. Below the large volume pump is a similar motor/pump unit 25 having a smaller displacement volume that is quantitatively and qualitatively monitored with associated apparatus 300 as described more expansively with respect to FIG. 3. Ordinarily, one or more sample tank magazine sections 26 are assembled below the small volume pump. Each magazine section 26 may have three or more fluid sample tanks 30.

The formation fluid extractor 22 comprises an extensible suction probe 27 that is opposed by bore wall feet 28. Both, the suction probe 27 and the opposing feet 28 are hydraulically extensible to firmly engage the wellbore walls. Construction and operational details of the fluid extraction tool 22 are more expansively described by U.S. Pat. No. 5,303,775, the specification of which is hereby incorporated by reference herein in its entirety.

Figures 3, 4:
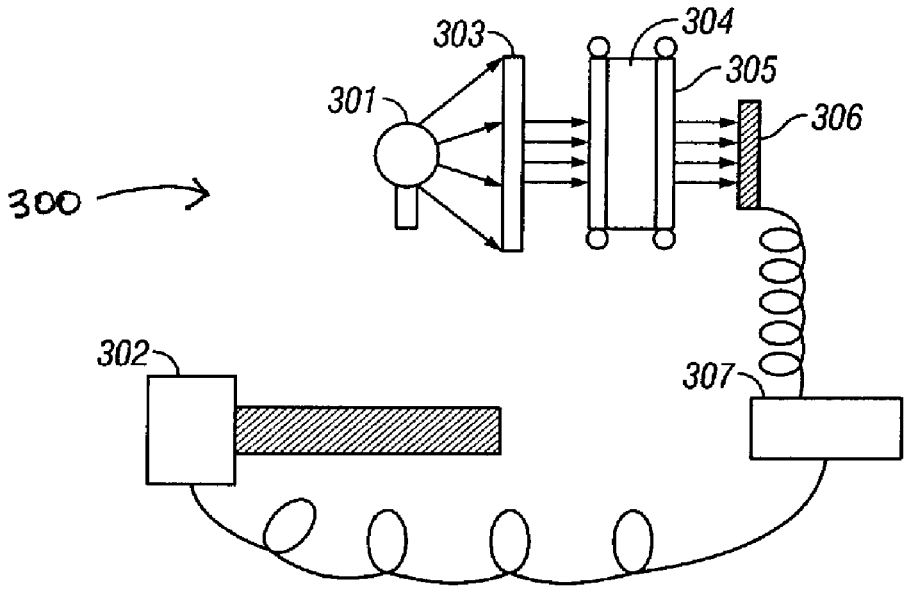
FIG. 3 is a schematic of a representative a exemplary embodiment of the present invention.
FIGS. 4-13, illustrate a series of dew point determination curves demonstrating the relationship between amount of light passing through the sample as shown on the y-axis (Power[watts]) and the pressure on the sample in pounds per square inch (PSI) on the x axis. As the pressure decreases, wattage or amount of light detected passing through the sample increases up to the dew point at which precipitation of asphaltenes and other solids in the sample begins to block light passing through the sample and power is reduced.
Figure 5:
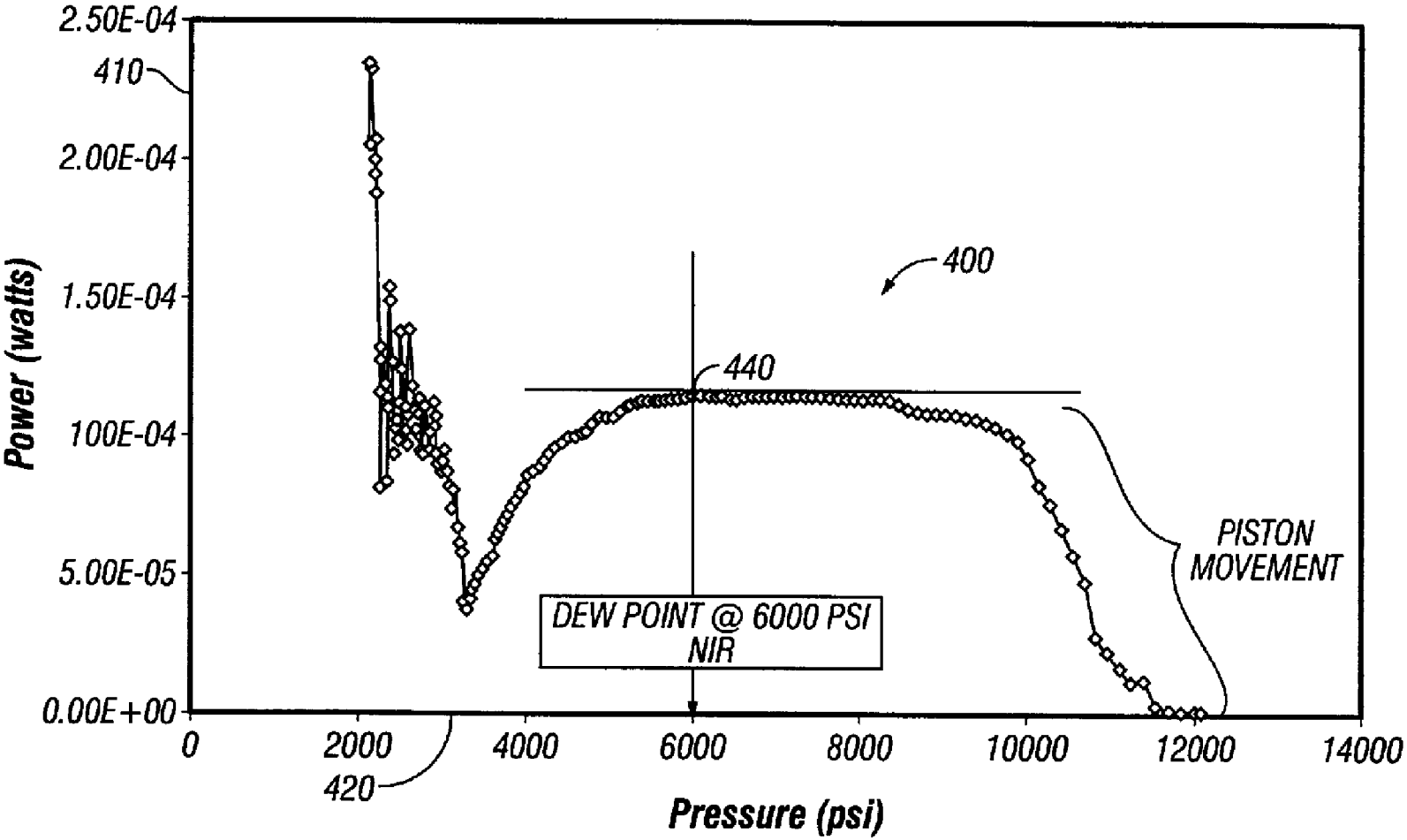
Figure 6:
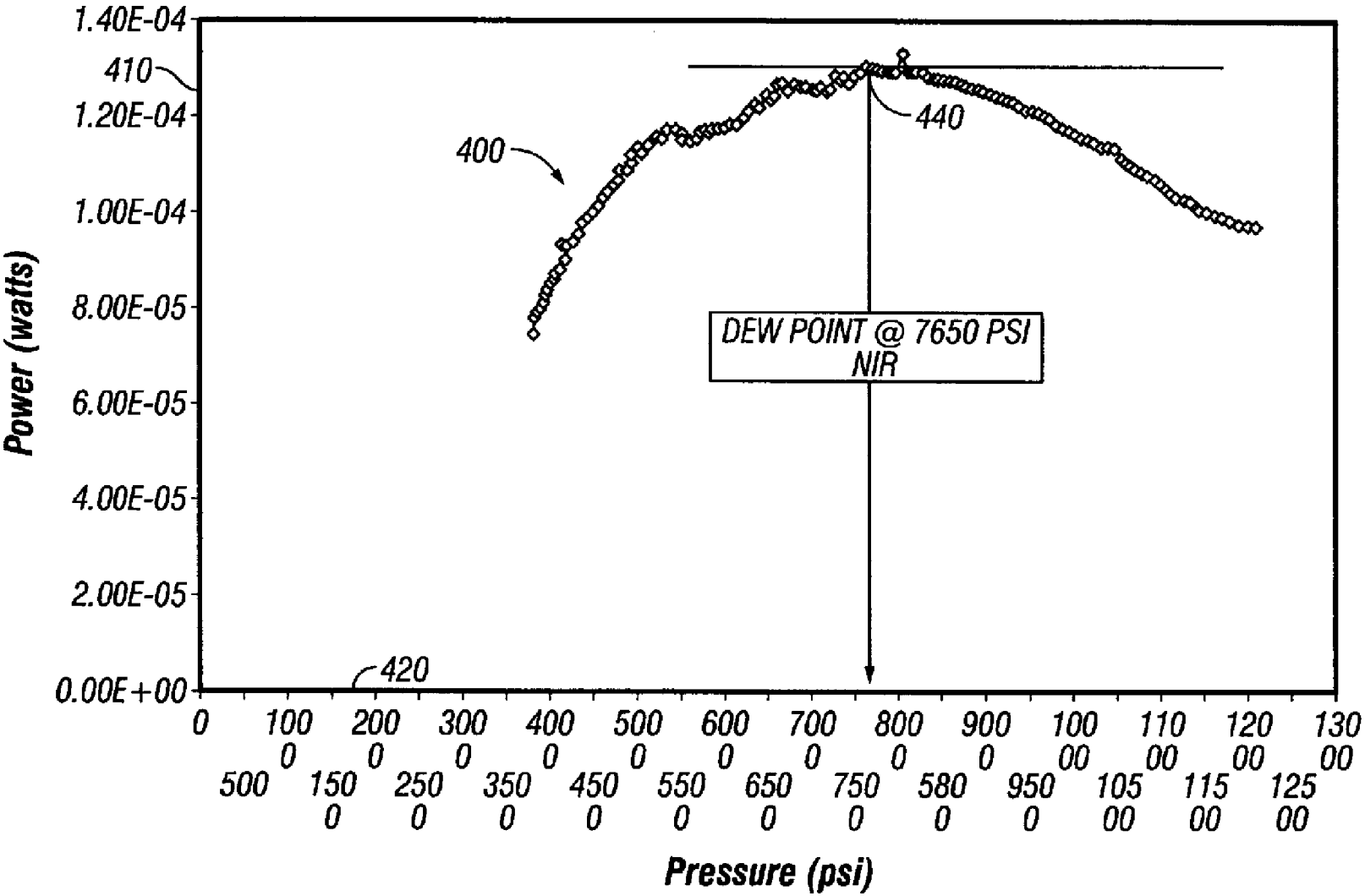
Figure 7:
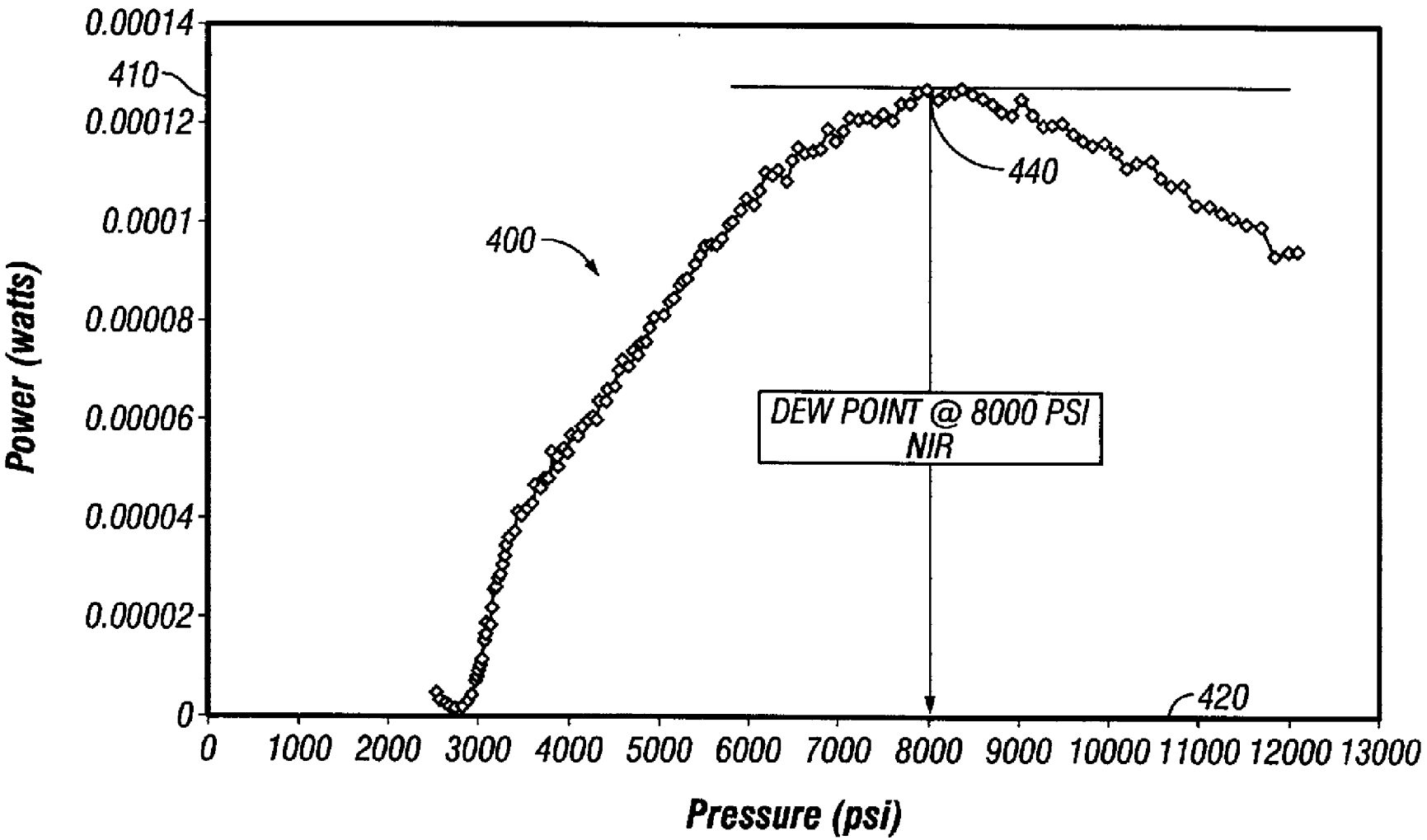
Figure 8:
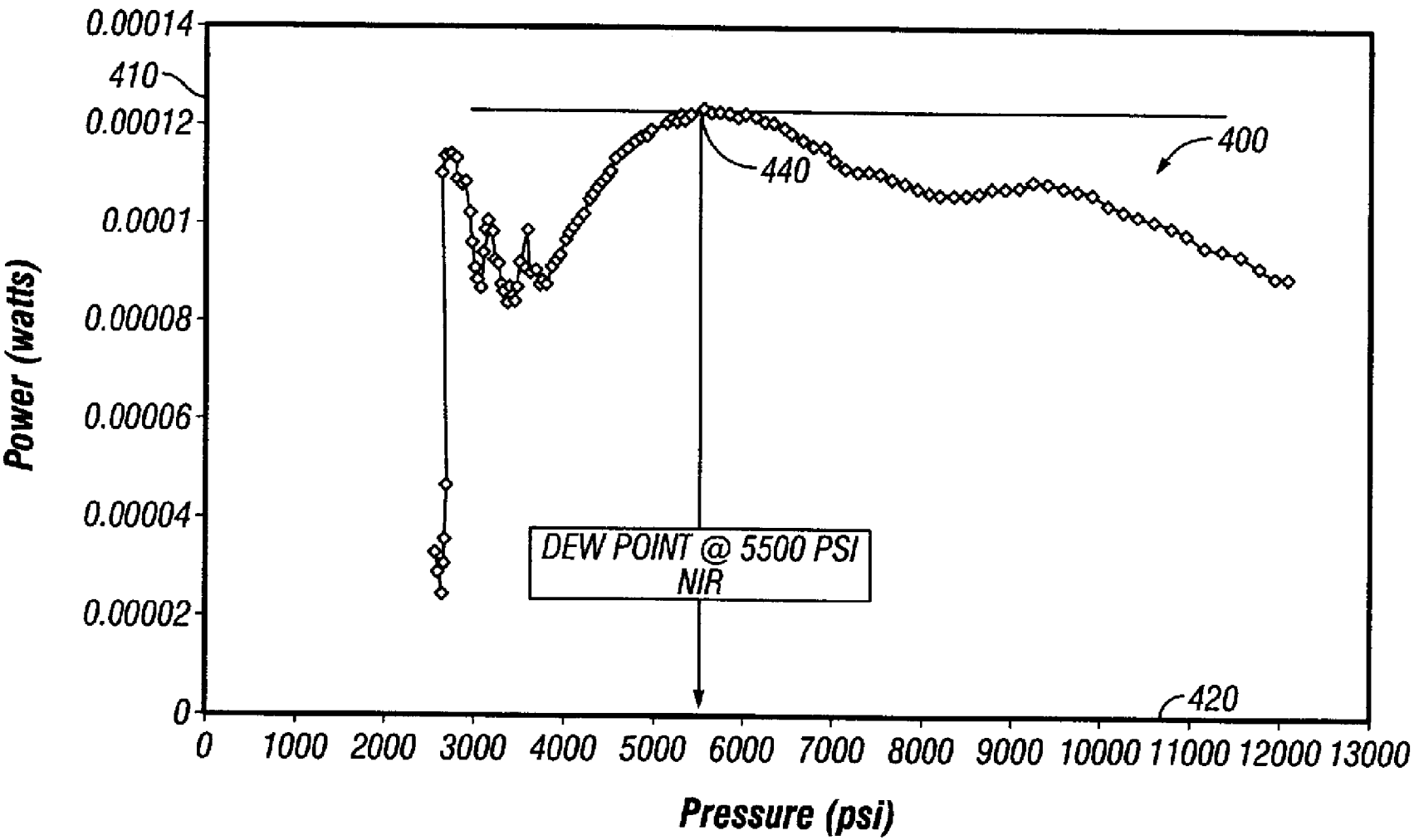
Figure 9:
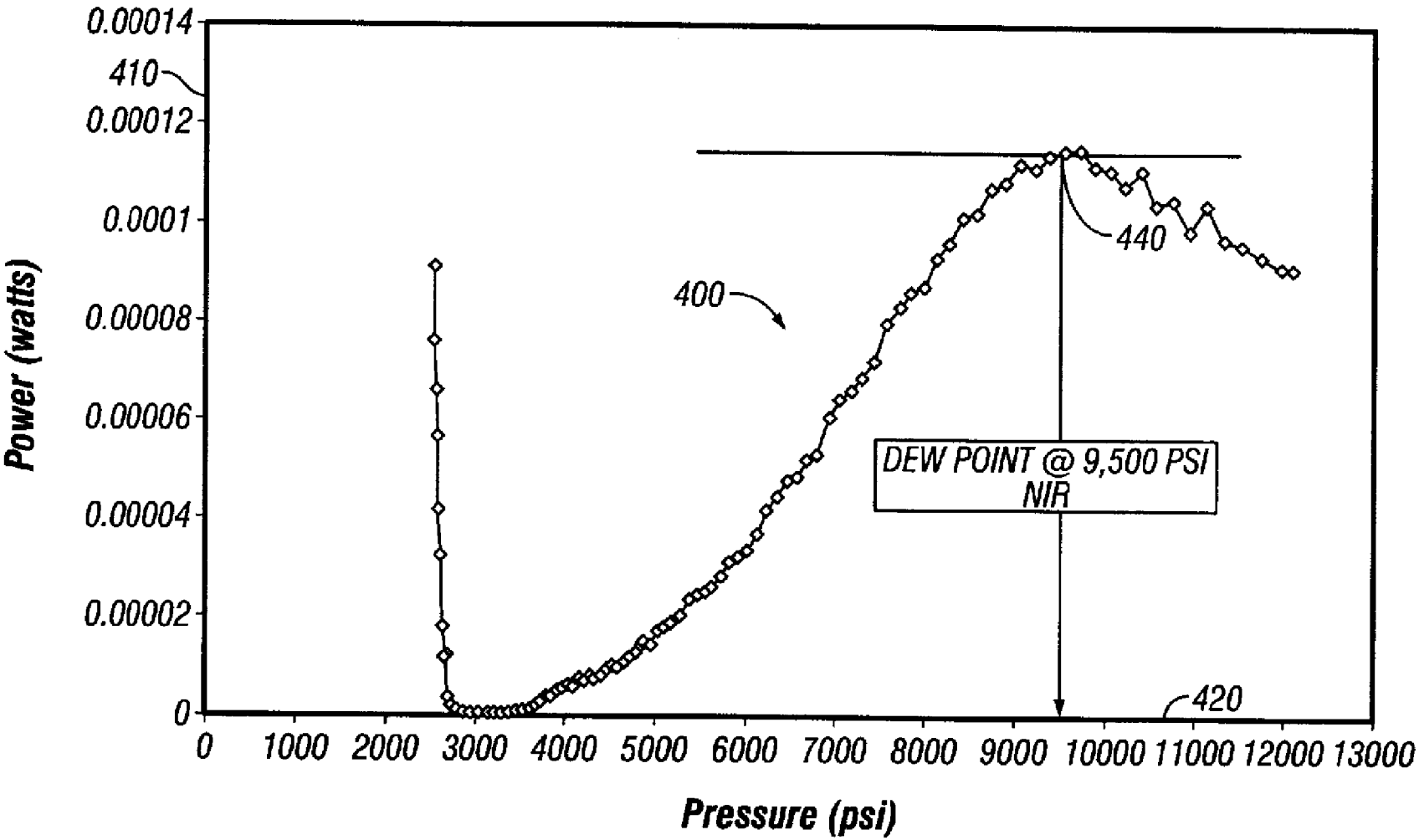

As shown in FIG. 3, the present example of the invention comprises an associated apparatus 300 with two sapphire windows, an infrared source 301 preferably at 1500 nm, a columnizer 303, a detector 306, and a computerized pump 302 having a pressure monitor. An example of a sequence of the testing at in situ condition follows:

1. The RCI™ pump is initiated to clean up the reservoir fluid by pumping formation fluid from the formation to substantially remove filtrate contamination from formation fluids adjacent the borehole wall. The formation fluid is subjected to near infrared analysis under source 301, detector 306 and computer 307. This process continues until the near infrared (NIR) or other wavelength analysis (i.e., Sample View™) output indicates a minimum mud filtrate contamination based on steady state or asymptotic NIR properties.
2. A portion of the formation sample 304 pumped from the formation in step 1 is isolated by valves in the tool into a controlled volume between the windows 305 and the pump 302.
3. The sample is allowed to stabilize at rest without pumping for five minutes.
4. To ensure stabilization, the pressure is monitored to ensure that the pressure does not change more than 0.2 pounds per square inch (PSI)/min.
5. The absorbance or power level through the hydrocarbon sample is checked by detector 306 to make sure that the system baseline is stable.
6. The absorbance NIR or other wavelength energy or power scale is zeroed in the detector 306 and/or computer 307.
7. The computerized pump is activated to expand the sample volume at rate of 3 to 14 cc/min and thereby reduce the pressure on the sample in the controlled volume.
8. A plot of absorbance or power through put (transmittance/absorbance) versus pressure is constructed by computer or processor 307 to determine the dew point or bubble point pressure.

The present invention provides a method and apparatus for determining a dew point pressure at which liquid hydrocarbons precipitate out of a formation sample. The dew point pressure is used as a reference value to determine an optimal pumping rate during sampling to avoid hydrocarbon loss in the sample. The equations for the determination for an optimal pumping rate based on a desired minimum pressure (above the dew point pressure or bubble point pressure) and a known mobility are described below in the section entitled "Determination of an Optimal Pump Rated Based on a Desired Minimum Pressure."

FIG. 4 is a dew point experiment data summary for the curves shown in FIGS. 5-13. Turning now to FIG. 5-FIG. 13, a series of dew point determination curves 400 are illustrated demonstrating the amount of light passing through the sample on the y-axis (Power [watts]) 410 and pressure in PSI on the x axis 420. Note that in FIGS. 5-13 that as the pressure decreases, wattage or amount of light detected passing through the sample increases up to the dew point at which precipitation of liquid hydrocarbon in the sample begins to block light passing through the sample and power is reduced. The pressure at which the power begins to reduce again is the dew point pressure 440.

The present invention provides a downhole spectrometer for determination of dew point pressure to determine an optimal pumping rate during sampling to avoid precipitation of asphaltenes in a formation sample. A sample is captured at formation pressure in a controlled volume. The pressure in the controlled volume is reduced. Initially the formation fluid sample appears dark and allows less light energy to pass through a sample under test. The sample under test, however, becomes lighter and allows more light energy to pass through the sample as the pressure is reduced and the formation fluid sample becomes thinner or less dense under the reduced pressure. At the dew point pressure, however, the sample begins to darken and allows less light energy to pass through it as liquid hydrocarbon begin to precipitate out of the sample. Thus, the dew point is that pressure at which peak light energy passes through the sample. The dew point pressure is plugged into an equation to determine the optimum pumping rate for a known mobility, during sampling to avoid dropping the pressure down to the dew point pressure to avoid hydrocarbon loss in the sample.

Determination of an Optimal Pump Rated Based on a Desired Minimum Pressure

Figure 12:
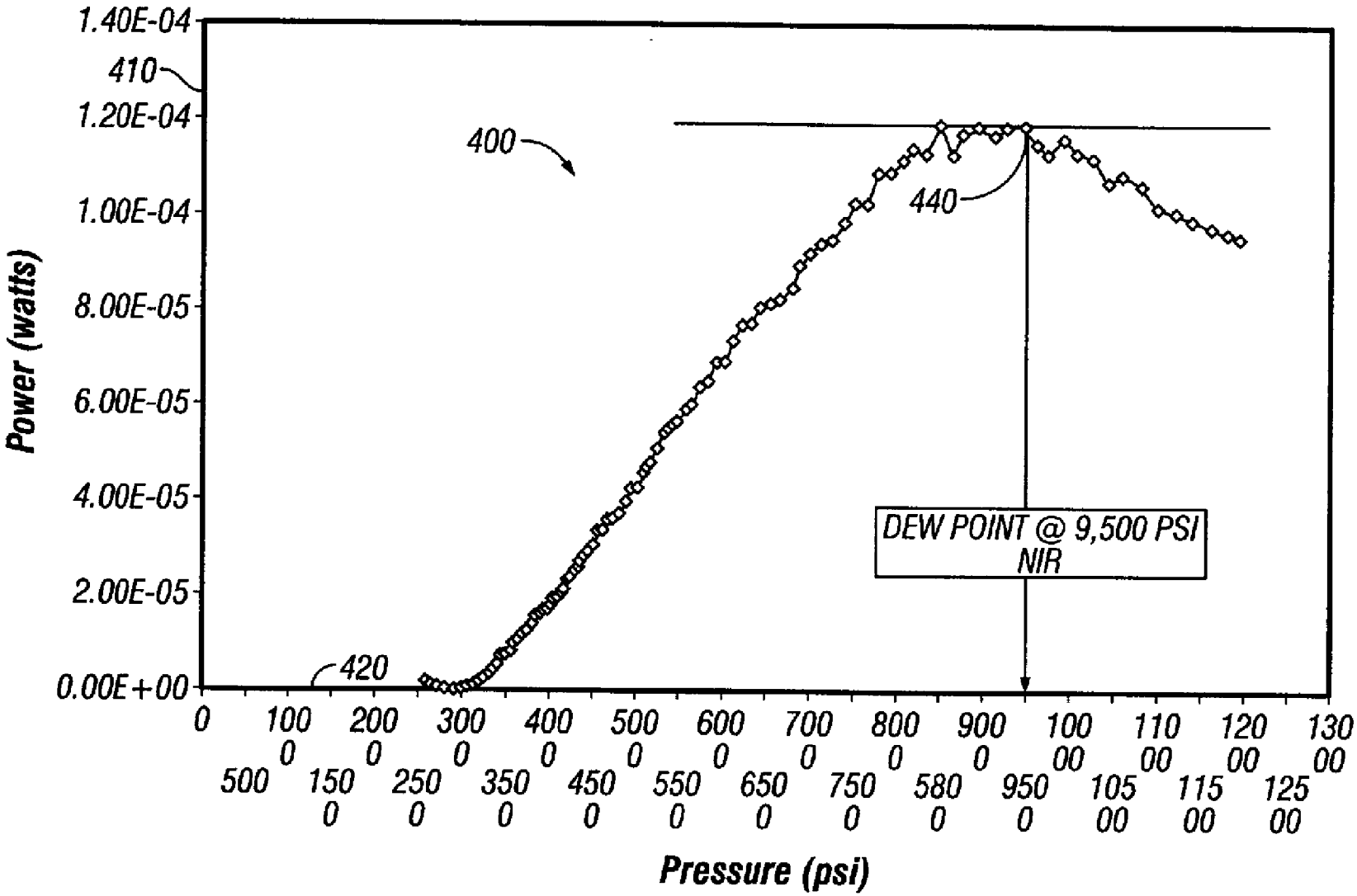
Figure 13:
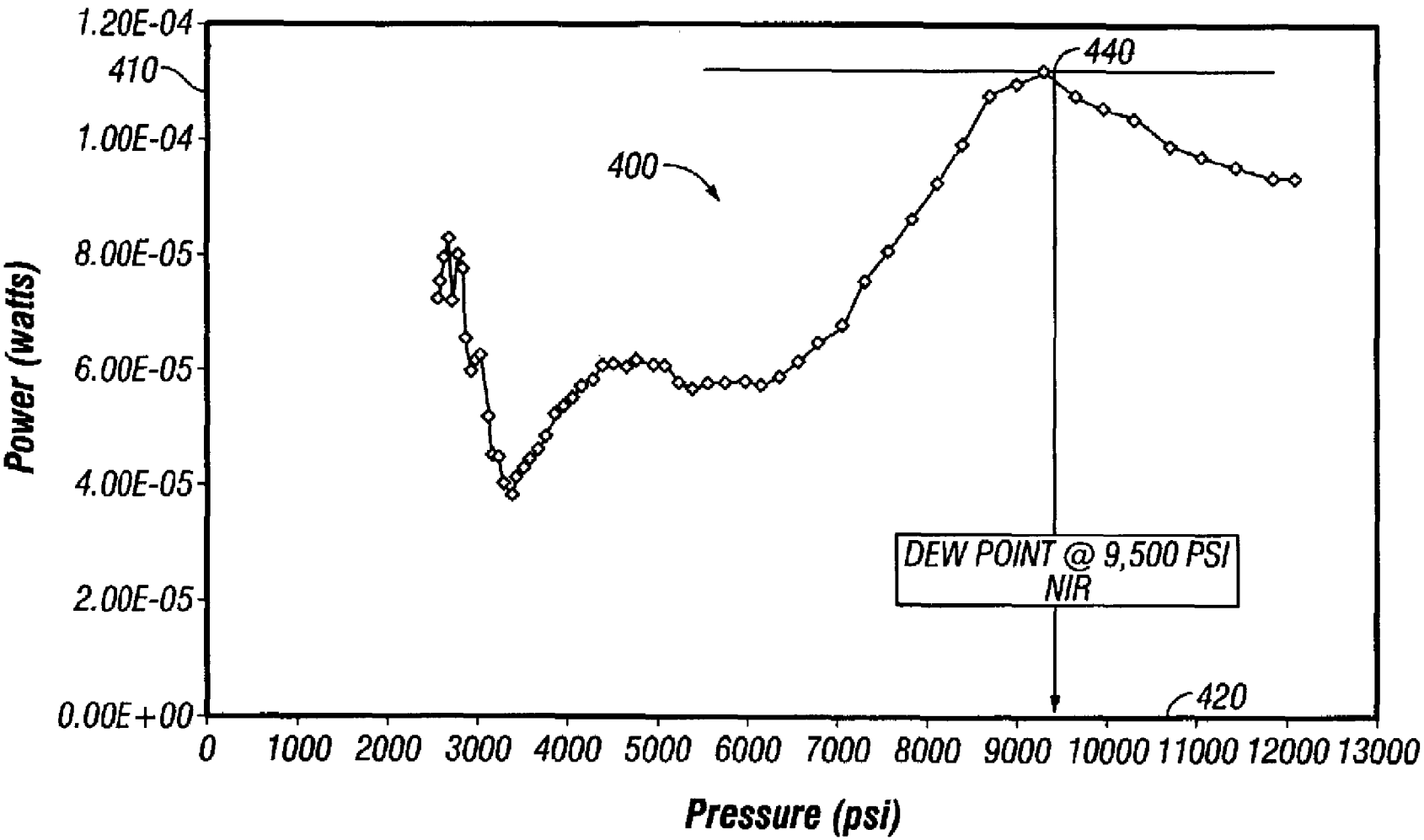
Figure 15:
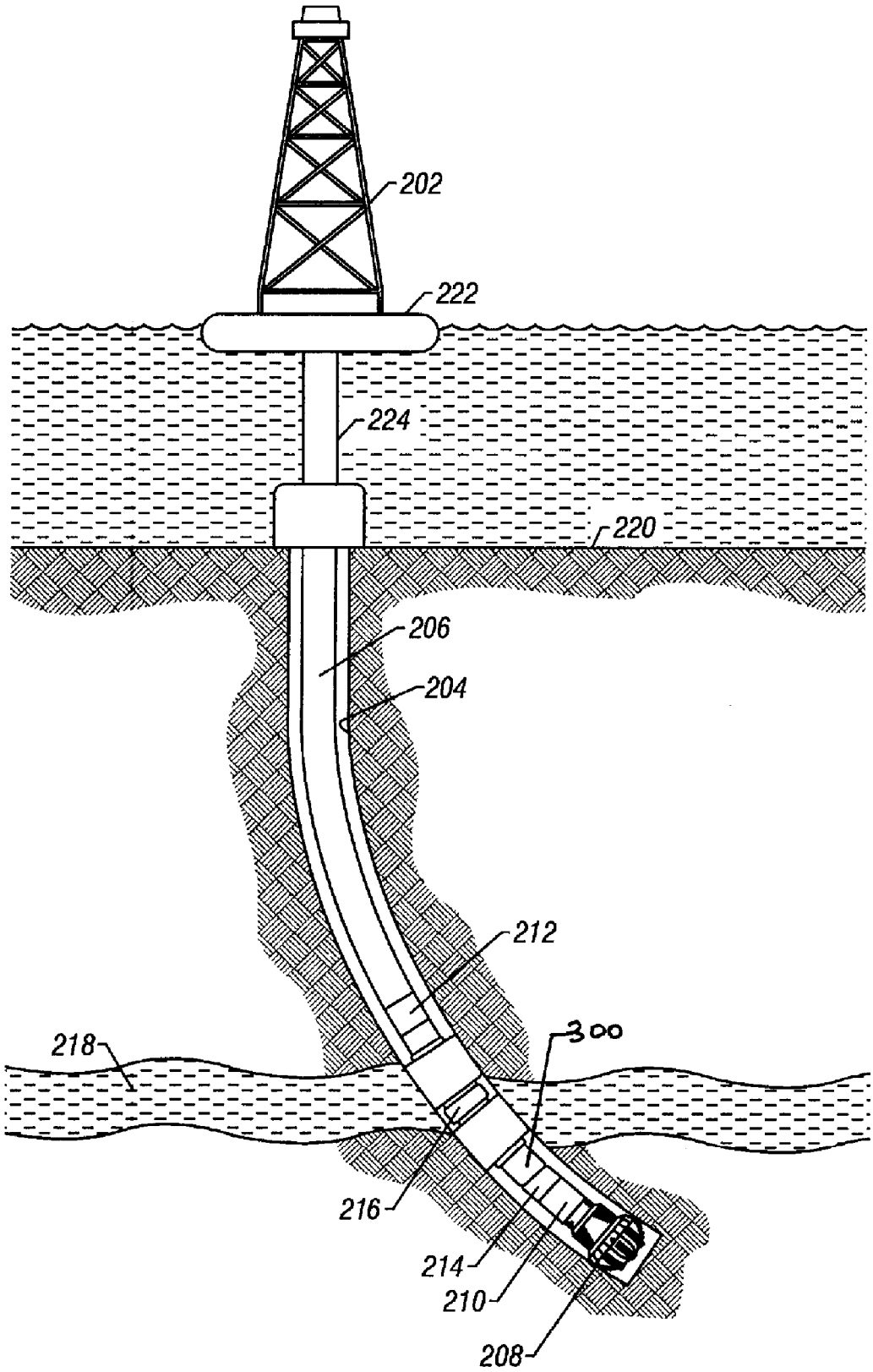
FIG. 15 is an elevation view of an offshore drilling system according to one embodiment of the present invention.

FIG. 15 is a drilling apparatus according to one embodiment of the present invention. A typical drilling rig 202 with a borehole 204 extending there from is illustrated, as is well understood by those of ordinary skill in the art. The drilling rig 202 has a work string 206, which in the embodiment shown is a drill string. The drill string 206 has attached thereto a drill bit 208 for drilling the borehole 204. The present invention is also useful in other types of work strings, and it is useful with a wireline (as shown in FIG. 12), jointed tubing, coiled tubing, or other small diameter work string such as snubbing pipe. The drilling rig 202 is shown positioned on a drilling ship 222 with a riser 224 extending from the drilling ship 222 to the sea floor 220. However, any drilling rig configuration such as a land-based rig may be adapted to implement the present invention.

If applicable, the drill string 206 can have a downhole drill motor 210. Incorporated in the drill string 206 above the drill bit 208 is a typical testing unit, which can have at least one sensor 214 to sense downhole characteristics of the borehole, the bit, and the reservoir, with such sensors being well known in the art. A useful application of the sensor 214 is to determine direction, azimuth and orientation of the drill string 206 using an accelerometer or similar sensor. The BHA also comprises associated formation test apparatus 300 of the present example of the invention as shown in FIG. 3. A telemetry system 212 is located in a suitable location on the work string 206 such as above the test apparatus 216. The telemetry system 212 is used for command and data communication between the surface and the test apparatus 216.

Figure 16:
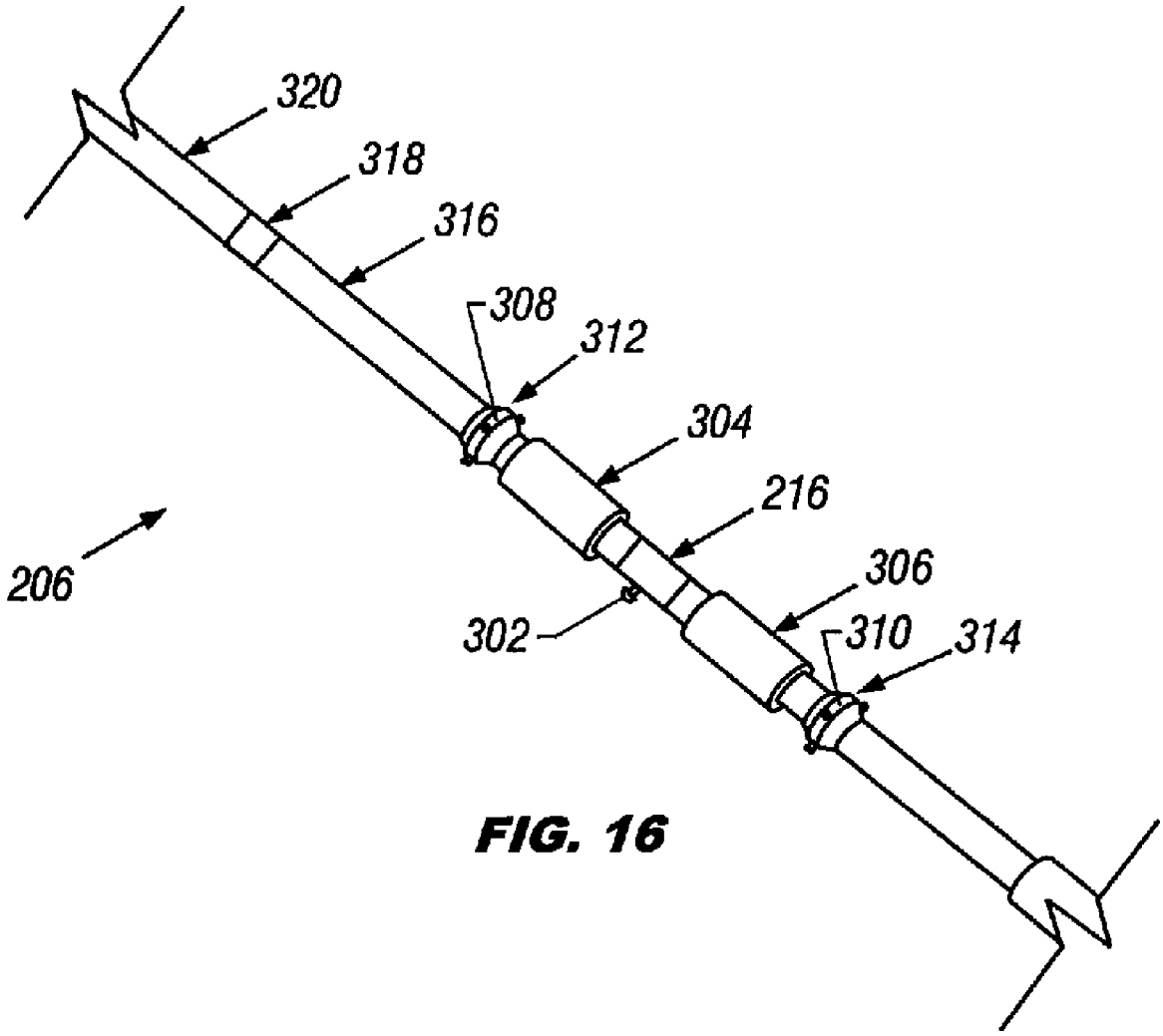
FIG. 16 shows a portion of drill string incorporating the present invention.

FIG. 16 is a section of drill string 206. The tool section is preferably located in a BHA close to the drill bit (not shown). The tool includes a communication unit and power supply 320 for two-way communication to the surface and supplying power to the downhole components. In the exemplary embodiment, the tool requires a signal from the surface only for test initiation. A downhole controller and processor (not shown) carry out all subsequent control. The power supply may be a generator driven by a mud motor (not shown) or it may be any other suitable power source. Also included are multiple stabilizers 308 and 310 for stabilizing the tool section of the drill string 206 and packers 304 and 306 for sealing a portion of the annulus. A circulation valve disposed preferably above the upper packer 304 is used to allow continued circulation of drilling mud above the packers 304 and 306 while rotation of the drill bit is stopped. A separate vent or equalization valve (not shown) is used to vent fluid from the test volume between the packers 304 and 306 to the upper annulus. This venting reduces the test volume pressure, which is required for a drawdown test. It is also contemplated that the pressure between the packers 304 and 306 could be reduced by drawing fluid into the system or venting fluid to the lower annulus, but in any case some method of increasing the volume of the intermediate annulus to decrease the pressure will be required.

Figure 14:
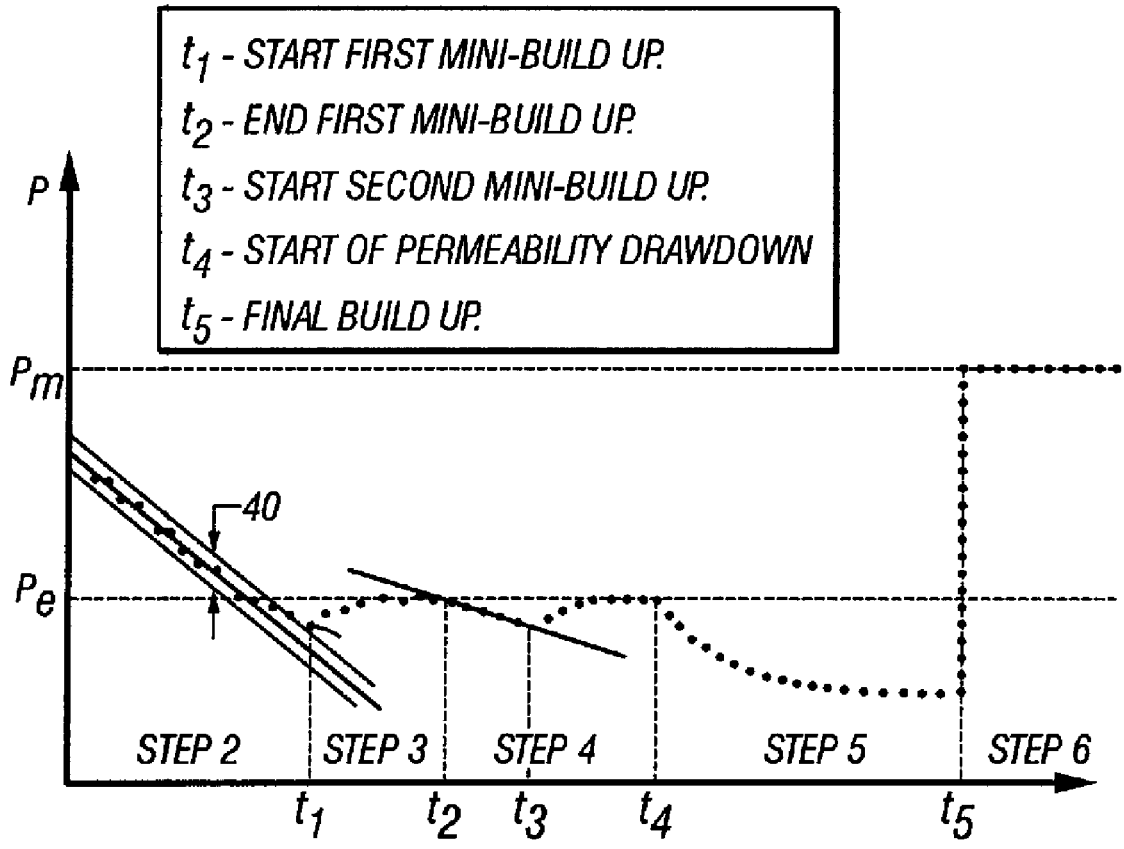
FIG. 14 (Prior Art)
FIG. 14 is a graphical qualitative representation a formation pressure test using a particular prior art method.

In one embodiment of the present invention an extendable pad-sealing element 302 for engaging the well wall 17 (FIG. 14) is disposed between the packers 304 and 306 on the test apparatus 216. The pad-sealing element 302 could be used without the packers 304 and 306, because a sufficient seal with the well wall can be maintained with the pad 302 alone. If packers 304 and 306 are not used, a counterforce is required so pad 302 can maintain sealing engagement with the wall of the borehole 204. The seal creates a test volume at the pad seal and extending only within the tool to the pump rather than also using the volume between packer elements. The apparatus 300 is also contained in the tool as shown in FIG. 16.

One way to ensure the seal is maintained is to ensure greater stability of the drill string 206. Selectively extendable gripper elements 312 and 314 could be incorporated into the drill string 206 to anchor the drill string 206 during the test. The grippers 312 and 314 are shown incorporated into the stabilizers 308 and 310 in this embodiment. The grippers 312 and 314, which would have a roughened end surface for engaging the well wall, would protect soft components such as the pad-sealing element 302 and packers 304 and 306 from damage due to tool movement. The grippers 312 would be especially desirable in offshore systems such as the one shown in FIG. 15, because movement caused by heave can cause premature wear out of sealing components.

Figure 17:
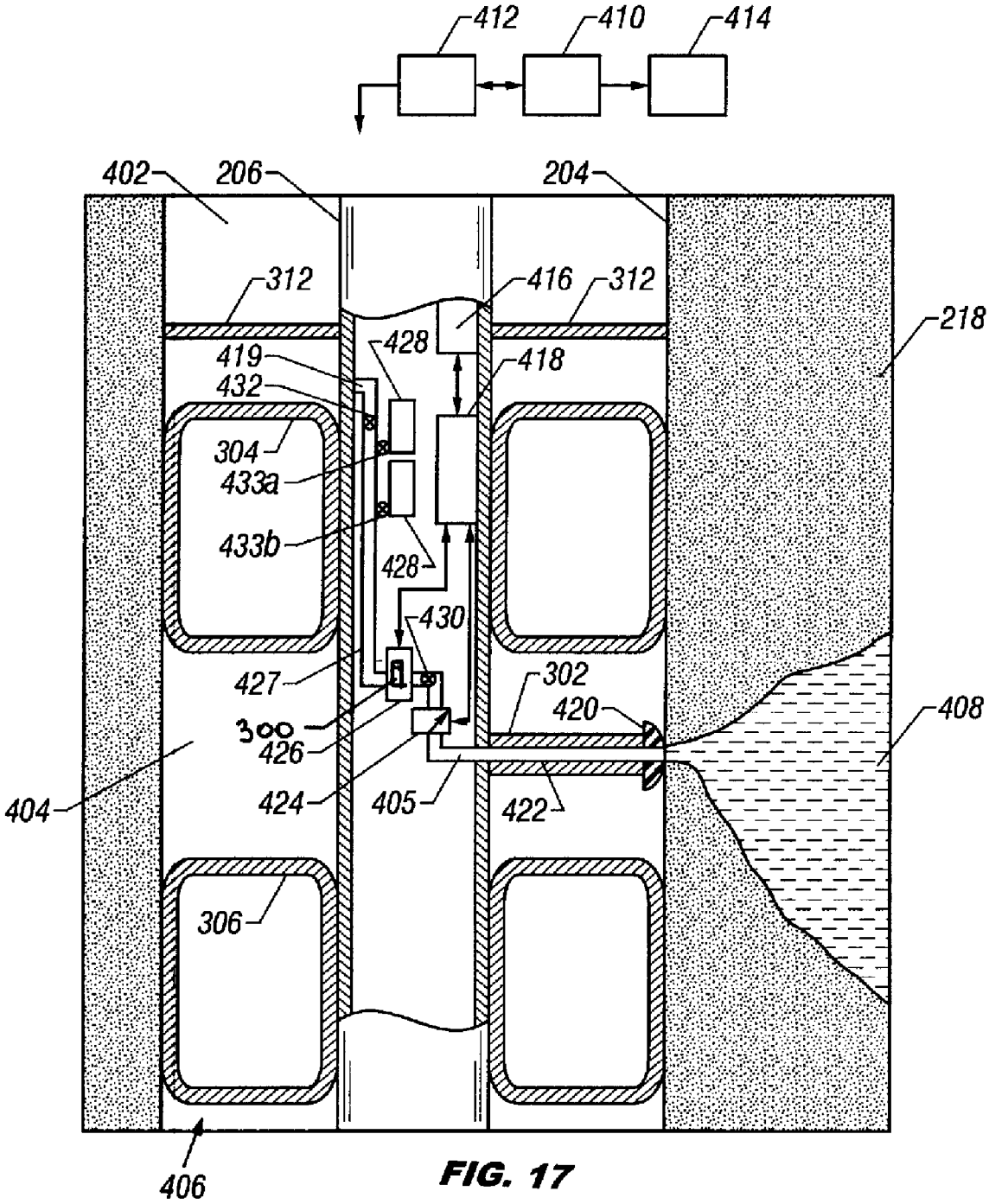
FIG. 17 is a system schematic of the present invention.

FIG. 17 shows the tool of FIG. 16 schematically with internal downhole and surface components. Selectively extendable gripper elements 312 engage the borehole wall 204 to anchor the drill string 206. Packer elements 304 and 306 well known in the art extend to engage the borehole wall 204. The extended packers separate the well annulus into three sections, an upper annulus 402, an intermediate annulus 404 and a lower annulus 406. The sealed annular section (or simply sealed section) 404 is adjacent a formation 218. Mounted on the drill string 206 and extendable into the sealed section 404 is the selectively extendable pad sealing element 302. A fluid line providing fluid communication between pristine formation fluid 408 and tool sensors such as pressure sensor 424 is shown extending through the pad member 302 to provide a port 420 in the sealed annulus 404. The preferable configuration to ensure pristine fluid is tested or sampled is to have packers 304 and 306 sealingly urged against the wall 204, and to have a sealed relationship between the wall and extendable element 302. Reducing the pressure in sealed section 404 prior to engaging the pad 302 will initiate fluid flow from the formation into the sealed section 404. With formation flowing when the extendable element 302 engages the wall, the port 420 extending through the pad 320 will be exposed to pristine fluid 408. Control of the orientation of the extendable element 302 is highly desirable when drilling deviated or horizontal wells. The exemplary orientation is toward an upper portion of the borehole wall. A sensor 214, such as an accelerometer, can be used to sense the orientation of the extendable element 302. The extendable element can then be oriented to the desired direction using methods and not-shown components well known in the art such as directional drilling with a bend-sub. For example, the drilling apparatus may include a drill string 206 rotated by a surface rotary drive (not shown). A downhole mud motor (see FIG. 15 at 210) may be used to independently rotate the drill bit. The drill string can thus be rotated until the extendable element is oriented to the desired direction as indicated by the sensor 214. The surface rotary drive is halted to stop rotation of the drill string 206 during a test, while rotation of the drill bit may be continued using the mud motor.

A downhole controller 418 preferably controls the test. The controller 418 is connected to at least one system volume control device (pump) 426 and associated apparatus 300. The pump 426 is a preferably small piston driven by a ball screw and stepper motor or other variable control motor, because of the ability to iteratively change the volume of the system. The pump 426 may also be a progressive cavity pump. When using other types of pumps, a flow meter should also be included. A valve 430 for controlling fluid flow to the pump 426 is disposed in the fluid line 422 between a pressure sensor 424 and the pump 426. A test volume 405 is the volume below the retracting piston of the pump 426 and includes the fluid line 422. The pressure sensor is used to sense the pressure within the test volume 404. It should be noted here that the test could be equally valuable if performed with the pad member 302 in a retracted position. In this case, the text volume includes the volume of the intermediate annulus 404. This allows for a "quick" test, meaning that no time for pad extension and retraction would be required. The sensor 424 is connected to the controller 418 to provide the feedback data required for a closed loop control system. The feedback is used to adjust parameter settings such as a pressure limit for subsequent volume changes. The downhole controller incorporates a processor (not separately shown) for further reducing test time, and an optional database and storage system could be incorporated to save data for future analysis and for providing default settings.

When drawing down the sealed section 404, fluid is vented to the upper annulus 402 via an equalization valve 419. A conduit 427 connecting the pump 426 to the equalization valve 419 includes a selectable internal valve 432. If fluid sampling is desired, the fluid may be diverted to optional sample reservoirs 428 by using the internal valves 432, 433*a*, and 433*b* rather than venting through the equalization valve 419. For typical fluid sampling, the fluid contained in the reservoirs 428 is retrieved from the well for analysis.

A exemplary embodiment for testing low mobility (tight) formations includes at least one pump (not separately shown) in addition to the pump 426 shown. The second pump should have an internal volume much less than the internal volume of the primary pump 426. A suggested volume of the second pump is 1/100 the volume of the primary pump. A typical "T" connector having selection valve controlled by the downhole controller 418 may be used to connect the two pumps to the fluid line 422.

In a tight formation, the primary pump is used for the initial draw down. The controller switches to the second pump for operations below the formation pressure. An advantage of the second pump with a small internal volume is that build-up times are faster than with a pump having a larger volume.

Results of data processed downhole may be sent to the surface in order to provide downhole conditions to a drilling operator or to validate test results. The controller passes processed data to a two-way data communication system 416 disposed downhole. The downhole system 416 transmits a data signal to a surface communication system 412. There are several methods and apparatus known in the art suitable for transmitting data. Any suitable system would suffice for the purposes of this invention. Once the signal is received at the surface, a surface controller and processor 410 converts and transfers the data to a suitable output or storage device 414. As described earlier, the surface controller 410 and surface communication system 412 is also used to send the test initiation command.

Figure 18:
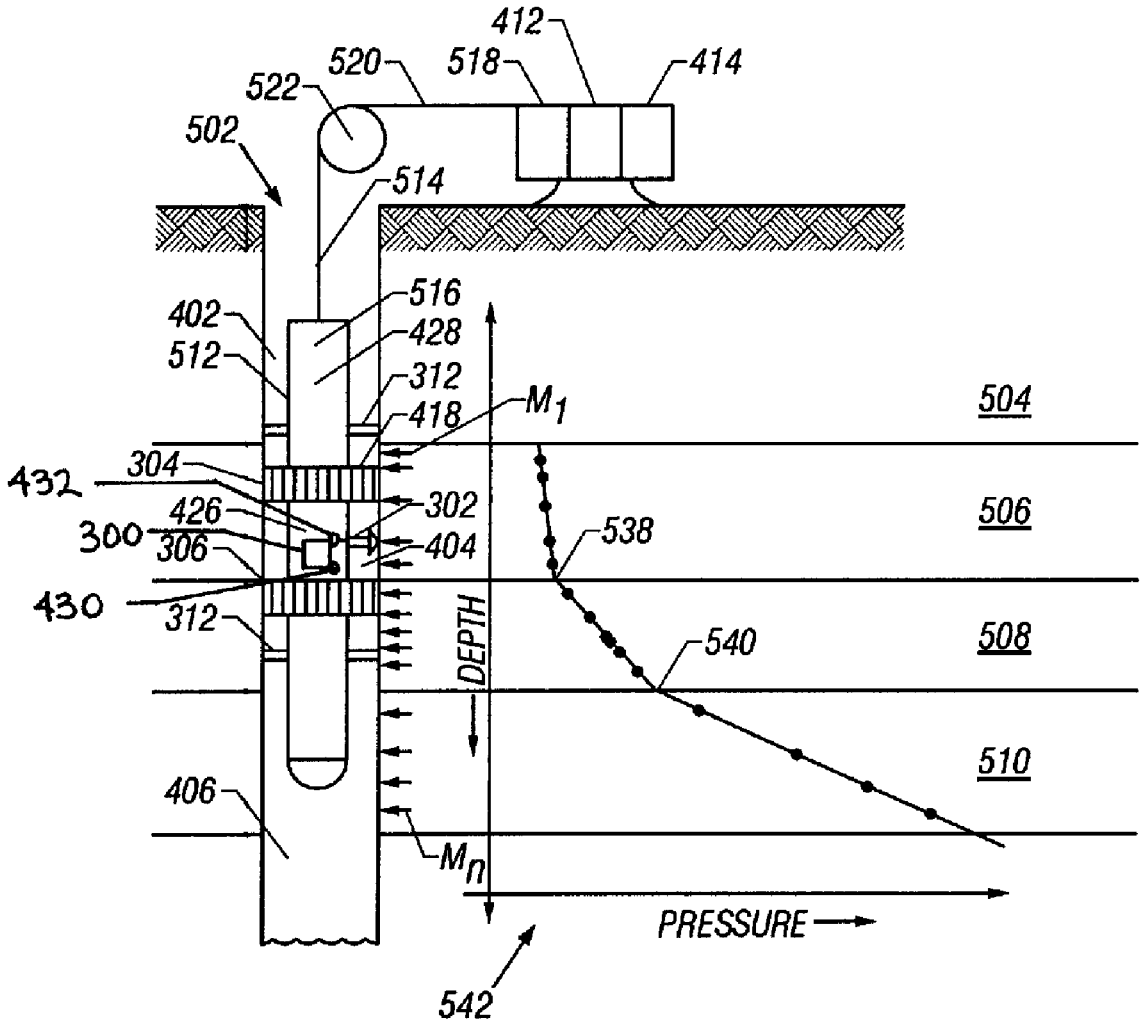
FIG. 18 is an elevation view of a wireline embodiment according to the present invention.

FIG. 18 is a wireline embodiment according to the present invention containing apparatus 300. A well 502 is shown traversing a formation 504 containing a reservoir having gas 506, oil 508 and water 510 layers. A wireline tool 512 supported by an armored cable 514 is disposed in the well 502 adjacent the formation 504. Extending from the tool 512 are optional grippers 312 for stabilizing the tool 512. Two expandable packers 304 and 306 are disposed on the tool 512 are capable of separating the annulus of the borehole 502 into an upper annulus 402, a sealed intermediate annulus 404 and a lower annulus 406. A selectively extendable pad member 302 is disposed on the tool 512. The grippers 312, packers 304 and 306, and extendable pad element 302 are essentially the same as those described in FIGS. 16 and 17, therefore the detailed descriptions are not repeated here.

Telemetry for the wireline embodiment is a downhole two-way communication unit 516 connected to a surface two-way communication unit 518 by one or more conductors 520 within the armored cable 514. The surface communication unit 518 is housed within a surface controller that includes a processor 412 and output device 414 as described in FIG. 17. A typical cable sheave 522 is used to guide the armored cable 514 into the borehole 502. The tool 512 includes a downhole processor 418 for controlling formation tests in accordance with methods to be described in detail later.

The embodiment shown in FIG. 18 is desirable for determining contact points 538 and 540 between the gas 506 and oil 508 and between the oil 508 and water 510. To illustrate this application a plot 542 of pressure vs. depth is shown superimposed on the formation 504. The downhole tool 512 includes a pump 426, a plurality of sensors 424, associated apparatus 300, associated valves 430, 432 and optional sample tanks 428 as described above for the embodiment shown in FIG. 17. These components are used to measure formation pressure at varying depths within the borehole 502. The pressures plotted as shown are indicative of fluid or gas density, which varies distinctly from one fluid to the next. Therefore, having multiple pressure measurements $M_1$-$M_n$ provides data necessary to determine the contact points 538 and 540.

Measurement strategies and calculation procedures for determining effective mobility ($k/\mu$) in a reservoir according to the present invention are described below. Measurement times are fairly short, and calculations are robust for a large range of mobility values. The initial pressure drawdown employs a much lower pump withdrawal rate, 0.1 to 0.2 $cm^3/s$, than rates typically used currently. Using lower rates reduces the probability of formation damage due to fines migration, reduces temperature changes related to fluid expansion, reduces inertial flow resistance, which can be substantial in probe permeability measurements, and permits rapid attainment of steady-state flow into the probe for all but very low mobilities.

Steady state flow is not required for low mobility values (less than about 2 md/cp). For these measurements, fluid compressibility is determined from the initial part of the drawdown when pressure in the probe is greater than formation pressure. Effective mobility and distant formation pressure, p*, are determined from the early portion of the pressure buildup, by methods presented herein, thus eliminating the need for the lengthy final portion of the buildup in which pressure gradually reaches a constant value.

For higher mobilities, where steady-state flow is reached fairly quickly during the drawdown, the pump is stopped to initiate the rapid pressure buildup. For a mobility of 10 md/cp, and the conditions used for the sample calculations described later herein (including a pump rate of 0.2 $cm^3/s$), steady-state flow occurs at a drawdown of about 54 psi below formation pressure. The following buildup (to within 0.01 psi of formation pressure) requires only about 6 seconds. The drawdown is smaller and the buildup time is shorter (both inversely proportional) for higher mobilities. Mobility can be calculated from the steady-state flow rate and the difference between formation and drawdown pressures. Different pump rates can be used to check for inertial flow resistance. Instrument modifications may be required to accommodate the lower pump rates and smaller pressure differentials.

Referring to FIG. 17, after the packers 304 and 306 are set and the pump piston is in its initial position with a full withdrawal stroke remaining, the pump 426 is started preferably using a constant rate ($q_{pump}$). The probe and connecting lines to the pressure gauge and pump comprise the "system volume," $V_{sys}$ which is assumed to be filled with a uniform fluid, e.g., drilling mud. As long as pressure in the probe is greater than the formation pressure, and the formation face at the periphery of the borehole is sealed by a mud cake, no fluid should flow into the probe. Assuming no leaks past the packer and no work-related expansion temperature decreases, pressure in the "system," at the datum of the pressure gauge, is governed by fluid expansion, equal to the pump withdrawal volume. Where $A_p$ is the cross sectional area of a pump piston, x is the travel distance of the piston, C is fluid compressibility, and p is system pressure, the rate of pressure decline depends on the volumetric expansion rate as shown in equation 1:

$$q_{pump} = A_p\left(\frac{dx}{dt}\right) = \frac{dV_p}{dt} = -CV_{sys}\left(\frac{dp}{dt}\right) \tag{1}$$

Equation 2 shows the system volume increases as the pump piston is withdrawn:

$$V_{sys}[t]=V_0+(x[t]-x_o)A_p=V_0+V_p[t], \tag{2}$$

and differentiation of Eq. 2 shows that:

$$\frac{dV_{sys}}{dt} = \frac{dV_p}{dt} \tag{3}$$

Therefore, substituting the results of Eq. 3 into Eq. 1 and rearranging:

$$\frac{-dV_{sys}}{CV_{sys}} \equiv \frac{-d\ln V_{sys}}{C} = dp \tag{4}$$

For constant compressibility, Eq. 4 can be integrated to yield pressure in the probe as a function of system volume:

$$P_n = P_{n-1} + \frac{1}{C}\ln\left[\frac{V_{sys_{n-1}}}{V_{sys_n}}\right]. \tag{5}$$

Pressure in the probe can be related to time by calculating the system volume as a function of time from Eq. 2. Conversely, if compressibility is not constant, its average value between any two system volume is:

$$C_{avg.} = \frac{\ln\left[\frac{V_{sys_{n-1}}}{V_{sys_n}}\right]}{P_2 - P_1} \tag{6}$$

where subscripts 1 and 2 are not restricted to being consecutive pairs of readings. Note that if temperature decreases during the drawdown, the apparent compressibility will be too low. A sudden increase in compressibility may indicate a pumping problem such as sanding the evolution of gas or a leak past the packer on the seal between the probe face and the bore hole wall. The calculation of compressibility, under any circumstances, is invalid whenever pressure in the probe is less than formation pressure when fluid can flow into the probe giving the appearance of a marked increase in compressibility. Note, however, that compressibility of real fluids almost invariably increases slightly with decreasing pressure.

Figure 19:
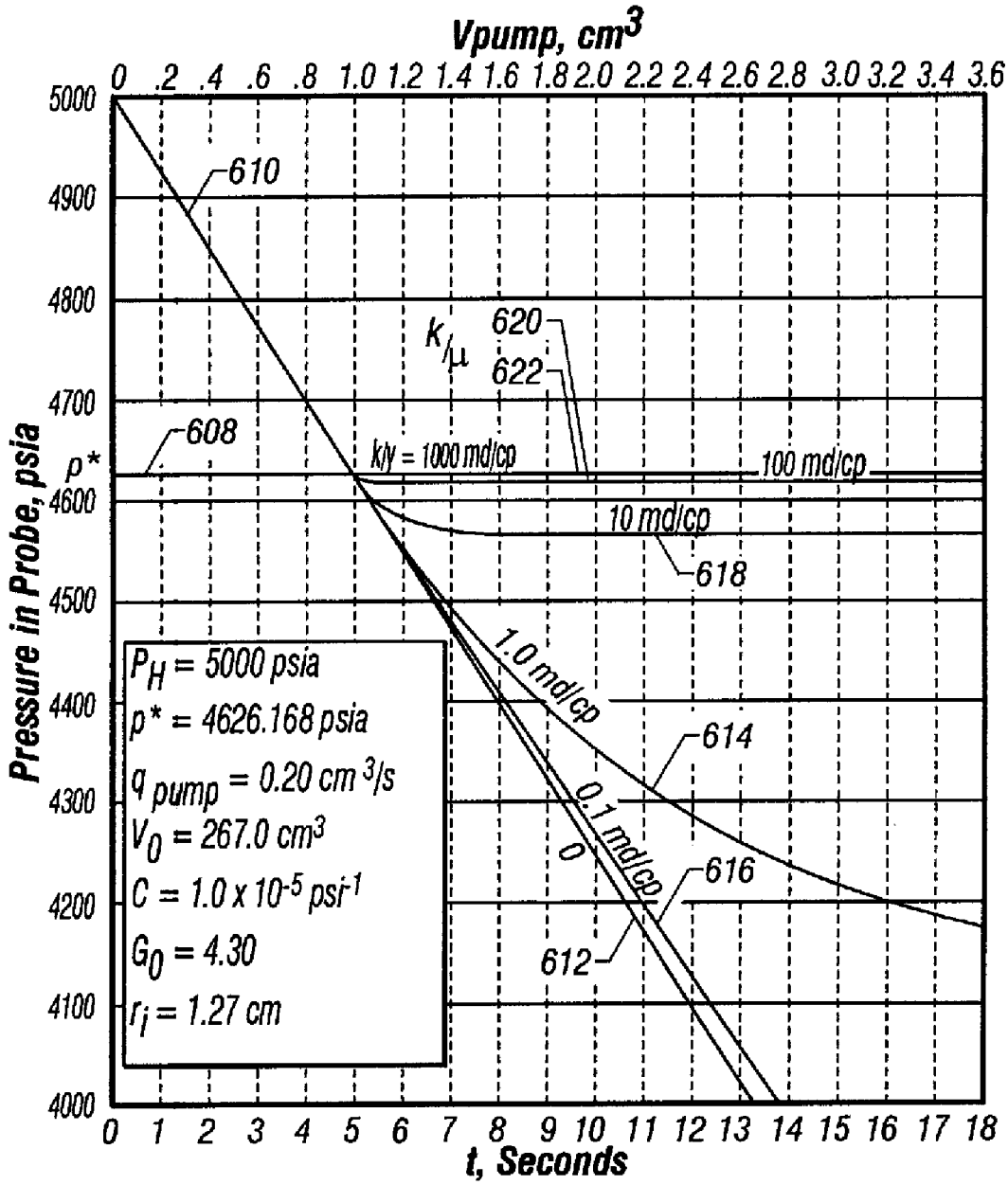
FIG. 19 is a plot graph of pressure vs. time and pump volume showing predicted drawdown behavior using specific parameters for calculation.

FIG. 19 shows an example of drawdown from an initial hydrostatic borehole pressure of 5000 psia to (and below) a reservoir pressure (p*) 608 of 4626.168 psia, calculated using the following conditions as an example:

Effective probe radius, $r_t$, of 1.27 cm;

Dimensionless geometric factor, $G_0$, of 4.30;

Initial system volume, $V_0$, of 267.0 $cm^3$;

Constant pump volumetric withdrawal rate $q_{pump}$ of 0.2 $cm^3/s$; and

Constant compressibility, C, of $1\times10^{-5}$ $psi^{-1}$.

The calculation assumes no temperature change and no leakage into the probe. The pressure drawdown is shown as a function of time or as a function of pump withdrawal volume, shown at the bottom and top respectively of the FIG. 19. The initial portion 610 of the drawdown (above p*) is calculated from Eq. 5 using $V_{sys}$ calculated from Eq. 2. Continuing the drawdown below reservoir pressure for no flow into the probe is shown as the "zero" mobility curve 612. Note that the entire "no flow" drawdown is slightly curved, due to the progressively increasing system volume.

Normally, when pressure falls below p* and permeability is greater than zero, fluid from the formation starts to flow into the probe. When p=p* the flow rate is zero, but gradually increases as p decreases. In actual practice, a finite difference may be required before the mud cake starts to slough off the portion of the borehole surface beneath the interior radius of the probe packer seal. In this case, a discontinuity would be observed in the time-pressure curve, rather than the smooth departure from the "no flow" curve as shown in FIG. 19. As long as the rate of system-volume-increase (from the pump withdrawal rate) exceeds the rate of fluid flow into the probe, pressure in the probe will continue to decline. Fluid contained in $V_{sys}$ expands to fill the flow rate deficit. As long as flow from the formation obeys Darcy's law, it will continue to increase, proportionally to (p*−p). Eventually, flow from the formation becomes equal to the pump rate, and pressure in the probe thereafter remains constant. This is known as "steady state" flow.

The equation governing steady state flow is:

$$\frac{k}{\mu} = \frac{14{,}696 q_{pump}}{G_0 r_i (p^* - p_{ss})} \tag{7}$$

For the conditions given for FIG. 19, the steady state drawdown pressure difference, $p^*-p_{ss}$, is 0.5384 psi for $k/\mu$=1000 md/cp, 5.384 psi for 100 md/cp, 53.84 psi for 10 md/cp, etc. For a pump rate of 0.1 $cm^3/s$, these pressure differences would be halved; and they would be doubled for a pump rate of 0.4 $cm^3/s$, etc.

As will be shown later, these high mobility draw downs have very fast pressure buildups after the pump-piston withdrawal is stopped. The value of p* can be found from the stabilized buildup pressure after a few seconds. In the case of high mobilities ($k/\mu$>50 md/cp), the pump rate may have to be increased in subsequent drawdown(s) to obtain an adequate drawdown pressure difference ($p^*-p$). For lower mobilities, it should be reduced to ascertain that inertial flow resistance (non-Darcy flow) is not significant. A total of three different pump rates would be desirable in these cases.

Steady-state calculations are very desirable for the higher mobilities because compressibility drops out of the calculation, and mobility calculations are straight forward. However, instrument demands are high: 1) pump rates should be constant and easy to change, and 2) pressure differences ($p^*-p_{ss}$) are small. It would be desirable to have a small piston driven by a ball screw and stepper motor to control pressure decline during the approach to steady state flow for low mobilities.

FIG. 19 shows that within the time period illustrated, the drawdown for the 1.0 md/cp curve 614 and lower mobilities did not reach steady state. Furthermore, the departures from the zero mobility curve for 0.1 md/cp 616 and below, are barely observable. For example, at a total time of 10 seconds, the drawdown pressure difference for 0.01 md/cp is only 1.286 psi less than that for no flow. Much greater pressure upsets than this, due to nonisothermal conditions or to small changes in fluid compressibility, are anticipated. Draw downs greater than 200-400 psi below p* are not recommended: significant inertial flow resistance (non-Darcy flow) is almost guaranteed, formation damage due to fines migration is likely, thermal upsets are more significantly unavoidable, gas evolution is likely, and pump power requirements are increased.

During the period when p<p* and before steady state flow is attained, three rates are operative: 1) the pump rate, which increases the system volume with time, 2) fluid flow rate from the formation into the probe, and 3) the rate of expansion of fluid within the system volume, which is equal to the difference between the first two rates. Assuming isothermal conditions, Darcy flow in the formation, no permeability damage near the probe face, and constant viscosity, drawdown curves for 10, 1, and 0.1 md/cp mobilities 618, 614 and 616, shown for FIG. 19, are calculated from an equation based on the relationship of these three rates as discussed above:

$$p_n = p_{n-1} + \frac{q_{f_n}(t_n - t_{n-1}) - (V_{pump_n} - V_{pump_{n-1}})}{C\left[V_0 + \frac{1}{2}(V_{pump_n} + V_{pump_{n-1}})\right]} \tag{8}$$

wherein, the flow rate into the probe from the formation at time step n, is calculated from:

$$q_{f_n} = \frac{kG_0 r_i\left[p^* - \frac{1}{2}(p_{n-1} + p_n)\right]}{14{,}696\mu} \tag{9}$$

Because $p_n$ is required for the calculation of $q_{f_n}$ in Eq. 9, which is required for the solution of Eq. 8, an iterative procedure was used. For the lower mobilities, convergence was rapid when using $p_{n-1}$ as the first guess for p. However, for the 10 md/cp curve, many more iterations were required for each time step, and this procedure became unstable for the 100 md/cp and higher mobility cases. Smaller time steps, and/or much greater damping (or a solver technique, rather than an iterative procedure) is required.

The pump piston is stopped (or slowed) to initiate the pressure buildup. When the piston is stopped, the system volume remains constant, and flow into the probe from the formation causes compression of fluid contained in the system volume and the consequent rise in pressure. For high mobility measurements, for which only steady-state calculations are performed, determination of fluid compressibility is not required. The buildup is used only to determine p*, so the pump is completely stopped for buildup. For the conditions given for FIG. 19, the buildup time, to reach within 0.01 psi of p* is about 6, 0.6, and 0.06 seconds for mobilities of 10, 100 and 1000 md/cp 618, 620 and 622, respectively.

For low mobility measurements, in which steady state was not reached during the drawdown, the buildup is used to determine both p* and $k/\mu$. However, it is not necessary to measure the entire buildup. This takes an unreasonable length of time because at the tail of the buildup curve, the driving force to reach p* approaches zero.

The equation governing the pressure buildup, assuming constant temperature, permeability, viscosity, and compressibility, is:

$$\frac{kG_0 r_i (p^* - p)}{14{,}696\mu} = -CV_{sys}\left(\frac{dp}{dt}\right). \tag{10}$$

Rearranging and integrating yields:

$$t - t_0 = \frac{14{,}696\mu CV_{sys}}{kG_0 r_i}\ln\left(\frac{p^* - p_0}{p^* - p}\right). \tag{11}$$

where $t_0$ and $p_0$, are the time and pressure in the probe, respectively, at the start of the buildup, or at any arbitrary point in the buildup curve.

Figure 20:
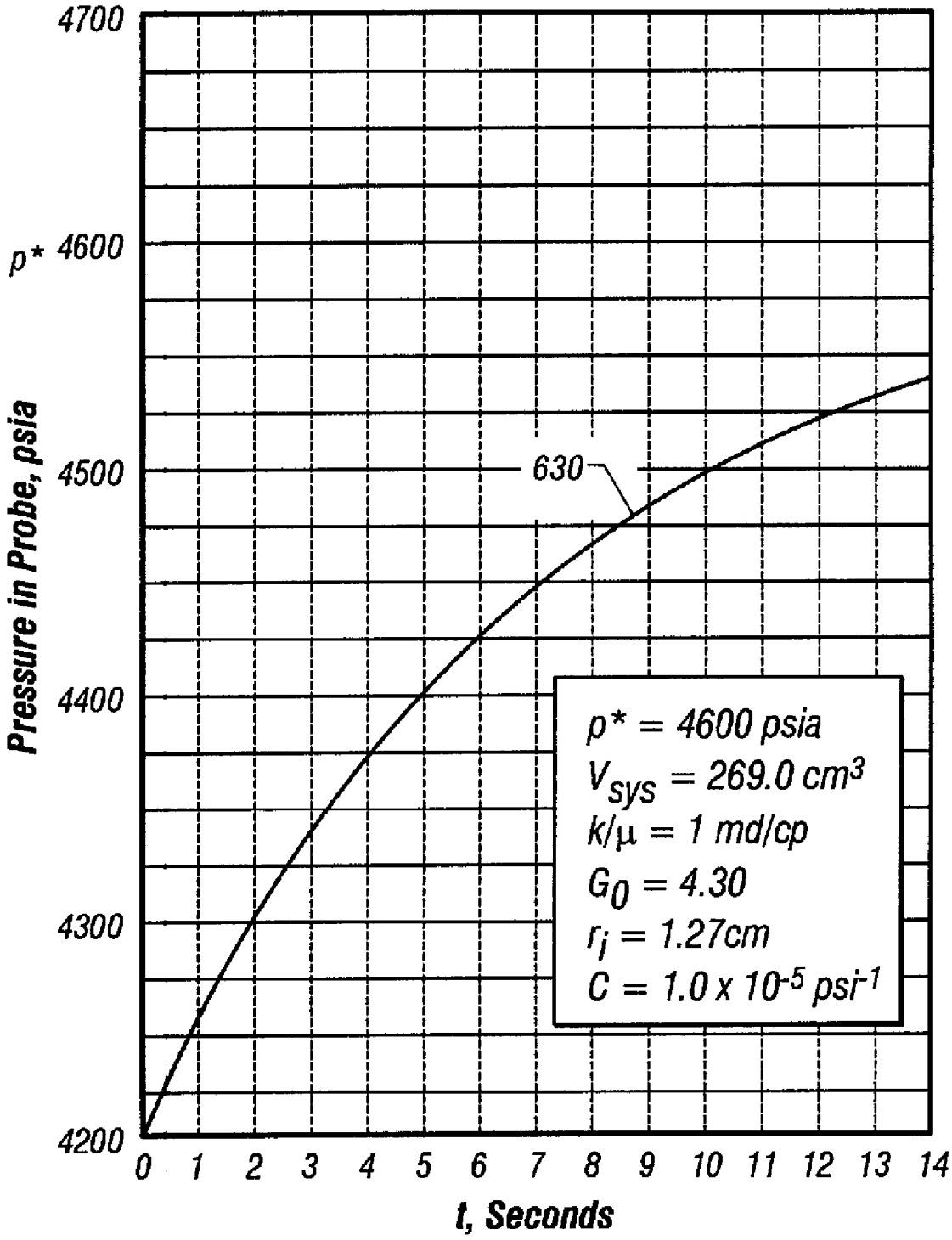
FIG. 20 is a plot graph of pressure vs. time showing the early portion of a pressure buildup curve for a moderately low permeability formation.

FIG. 20 is a plot of the early portion of a buildup curve 630 for a 1 md/cp mobility, which starts at 4200 psia, and if run to completion, would end at a p* of 4600. This is calculated from Eq. 11. In addition to the other parameters shown on this figure, $p_o$=4200 psia.

Determining p* from an incomplete buildup curve can be described by way of an example. Table 2 represents hypothetical experimental data. The challenge is to determine accurately the value of p*, which would not otherwise be available. To obtain p* experimentally would have taken at least 60 s, instead of the 15 s shown. The only information known in the hypothetical are the system values for FIG. 19 and $V_{sys}$ of 269.0 $cm^3$. The compressibility, C, is determined from the initial drawdown data starting at the hydrostatic borehole pressure, using Eq. 6.

TABLE 2

Hypothetical Pressure Buildup Data From A Moderately Low Permeability Reservoir

| $t-t_0$, s | p, psia |
|---|---|
| 0.0000 | 4200 |
| 0.9666 | 4250 |
| 2.0825 | 4300 |
| 3.4024 | 4350 |
| 5.0177 | 4400 |
| 5.9843 | 4425 |
| 7.1002 | 4450 |
| 8.4201 | 4475 |
| 10.0354 | 4500 |
| 12.1179 | 4525 |
| 15.0531 | 4550 |

The first group on the right side of Eq. 11 and preceding the logarithmic group can be considered the time constant, τ, for the pressure buildup. Thus, using this definition, and rearranging Eq. 11 yields:

$$\ln\left(\frac{p^* - p_0}{p^* - p}\right) = \left(\frac{1}{\tau}\right)(t - t_0), \tag{12}$$

Figure 21:
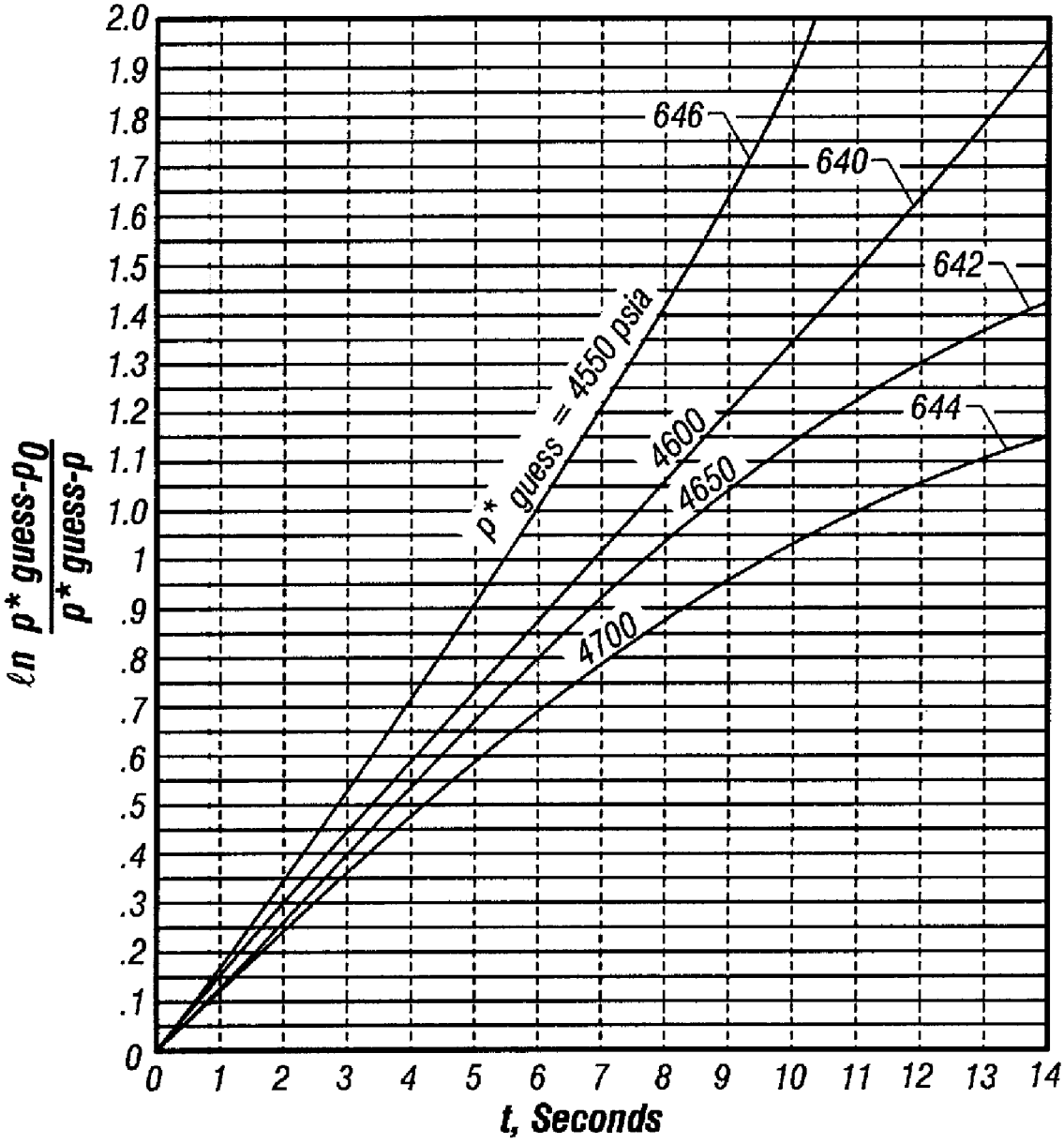
FIG. 21 is a plot graph of a method using iterative guesses for determining formation pressure.

A plot of the left side of Eq. 12 vs. $(t-t_0)$ is a straight line with slope equal to $(1/\tau)$, and intercept equal to zero. FIG. 21 is a plot of data from Table 2, using Eq. 12 with various guesses for the value of p*. We can see that only the correct value, 4600 psia, yields the required straight line 640. Furthermore, for guesses that are lower than the correct p*, the slope of the early-time portion of a curve 646 is smaller than the slope at later times. Conversely, for guesses that are too high, the early-time slope is larger than late-time slopes for the curves 642 and 644.

These observations can be used to construct a fast method for finding the correct p*. First, calculate the average slope from an arbitrary early-time portion of the data shown in Table 2. This slope calculation starts at $t_1$, and $p_1$, and ends at $t_2$ and $p_2$. Next calculate the average late-time slope from a later portion of the table. The subscripts for beginning and end of this calculation would be 3 and 4, respectively. Next divide the early-time slope by the late-time slope for a ratio R:

$$R = \frac{\ln\left(\frac{p^* - p_1}{p^* - p_2}\right)(t_4 - t_3)}{\ln\left(\frac{p^* - p_3}{p^* - p_4}\right)(t_2 - t_1)} \tag{13}$$

Suppose we choose the second set of data points from Table 2: 2.0825 s and 4300 psia for the beginning of the early-time slope. Suppose further that we select data from sets 5, 9, and 11 as the end of the early time slope, and beginning and end of the late-time slope, respectively, with corresponding subscripts 2, 3, and 4. If we now guess that p* is 4700 psia, then insert these numbers into Eq. 13, the calculated value of R is 1.5270. Because this is greater than 1, the guess was too high. Results of this and other guesses for p* while using the same data above are shown as a curve plot 650 in FIG. 22. The correct value of p*, 4600 psia, occurs at R=1. These calculations can easily be incorporated into a solver routine, which converges rapidly to the correct p* without plots. Mobility, having found the correct p*, is calculated from a rearrangement of Eq. 11, using the compressibility obtained from the initial hydrostatic drawdown.

In general, for real data, the very early portion of the buildup data should be avoided for the calculations of p*, then k/μ. This fastest portion of the buildup, with high pressure differences, has the greatest thermal distortion due to compressive heating, and has the highest probability of non-Darcy flow. After p* has been determined as described above, the entire data set should be plotted per FIG. 20. Whenever the initial portion of the plot displays an increasing slope with increasing time, followed by a progressively more linear curve, this may be a strong indication of non-Darcy flow at the higher pressure differences.

Figure 23:
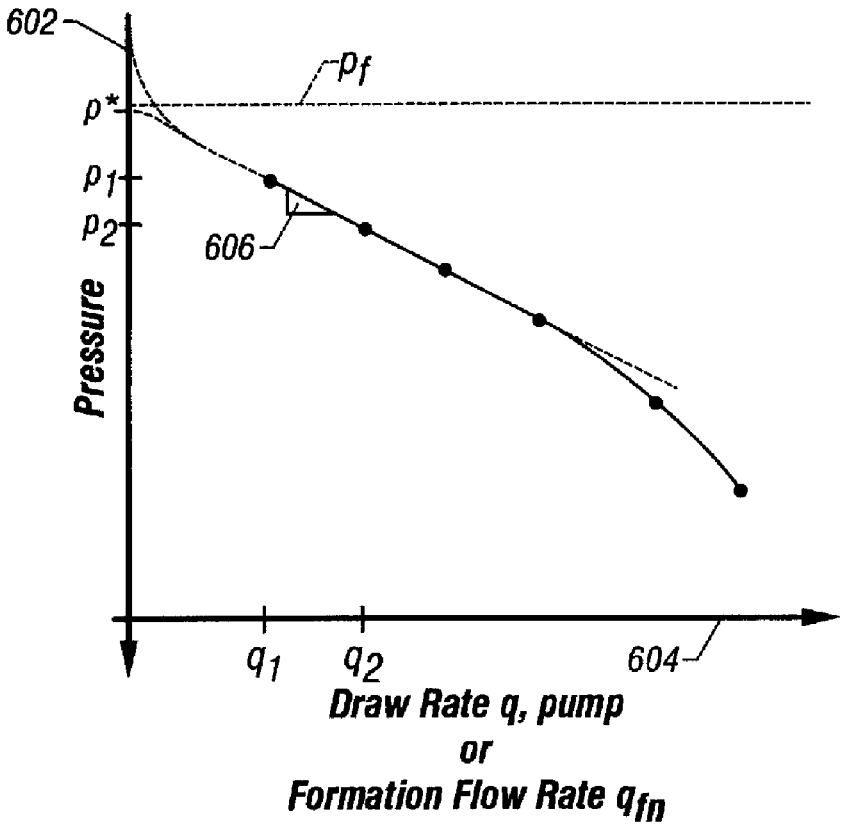
FIG. 23 is a plot graph of pressure vs. draw rate illustrating a computation technique used in a method according to the present invention to determine formation pressure.

Another method according to the present invention can be described with reference to FIG. 23. FIG. 23 shows a relationship between tool pressure 602 and formation flow rate $q_{fn}$ 604 along with the effect of rates below and above certain limits. Darcy's Law teaches that pressure is directly proportional to fluid flow rate in the formation. Thus, plotting pressure against a drawdown piston draw rate will form a straight line when the pressure in the tool is constant while the piston is moving at a given rate. Likewise, the plot of flow rates and stabilized pressures will form a straight line, typically with a negative slope (m) 606, between a lower and an upper rate limit. The slope is used to determine mobility (k/μ) of fluid in the formation. Equation 8 can be rearranged for the formation flow rate:

$$q_{fn} = \frac{(V_{pump_n} - V_{pump_{n-1}}) - C\left[V_0 + \frac{1}{2}(V_{pump_n} + V_{pump_{n-1}})\right](p_{n-1} - p_n)}{(t_n - t_{n-1})} \tag{14}$$

Equation 14 is valid for non-steady-state conditions as well as steady-state conditions. Formation flow rate $q_{fn}$ can be calculated using Eq. 14 for non-steady-state conditions when C is known reasonably accurately to determine points along the plot of FIG. 23.

Steady-state conditions will simplify Eq. 14 because $(p_{n-1}-p_n)=0$. Under steady state conditions, known tool parameters and measured values may be used to determine points along the straight line region of FIG. 23. In this region, the pump rate $q_{pump}$ can be substituted. Then using $q_{pump}$ in equation 9 yields:

$$\frac{k}{\mu} = \frac{-14696}{mG_0 r_i} \tag{15}$$

In Eq. 15, $m=(p^*-p_{ss})/q_{pump}$. The units for k/μ are in md/cp, $p_n$ and p* are in psia, $r_i$ is in cm, $q_{fn}$ is in $cm^3/s$, $V_{pump}$ and $V_0$ are in $cm^3$, C is in $psi^{-1}$, and t is in s. Each pressure on the straight line is a steady state pressure at the given flow rate (or draw rate).

In practice, a deviation from a straight line near zero formation flow rate (filtrate) may be an indicator of drilling mud leakage into the tool (flow rate approximately zero). The deviation at high flow rates is typically a non-Darcy effect. However, the formation pressure can be determined by extending the straight line to an intercept with zero draw rate.

The calculated formation pressure p* should equal a measured formation pressure within a negligible margin of error.

The purpose of a pressure test is to determine the pressure in the reservoir and determine the mobility of fluid in that reservoir. A procedure adjusting the piston draw rate until the pressure reading is constant (zero slope) provides the information to determine pressure and mobility independently of a "stable" pressure build up using a constant volume.

Some advantages of this procedure are quality assurance through self-validation of a test where a stable build up pressure is observed, and quality assurance through comparison of drawdown mobility with build up mobility. Also, when a build up portion of a test is not available (in the cases of lost probe seal or excessive build up time), p* provides the formation pressure.

Figure 24:
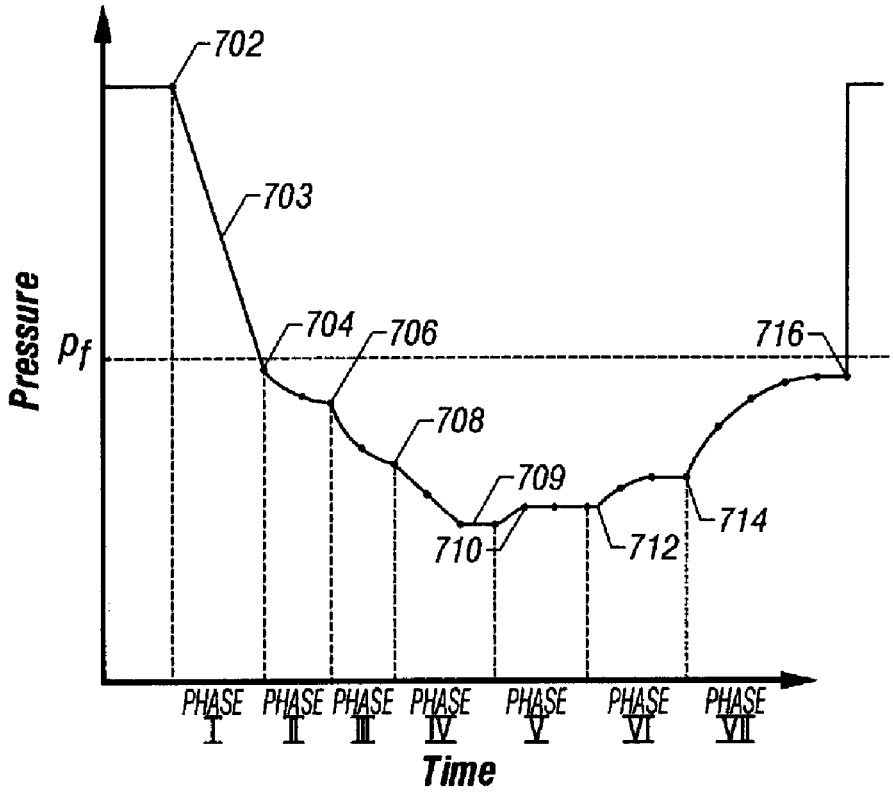
FIG. 24 is a graphical representation illustrating a method according to the present invention.

FIG. 24 is an exemplary plot of tool pressure vs. time using another method according to the present invention. The plot illustrates a method that involves changing the drawdown piston draw rate based on the slope of the pressure-time curve. Sensor data acquired at any point can be used with Eq. 14 to develop a plot as in FIG. 23 or used in automated solver routines controlled by a computer. Data points defining steady state pressures at various flow rates can be used to validate tests.

Figure 22:
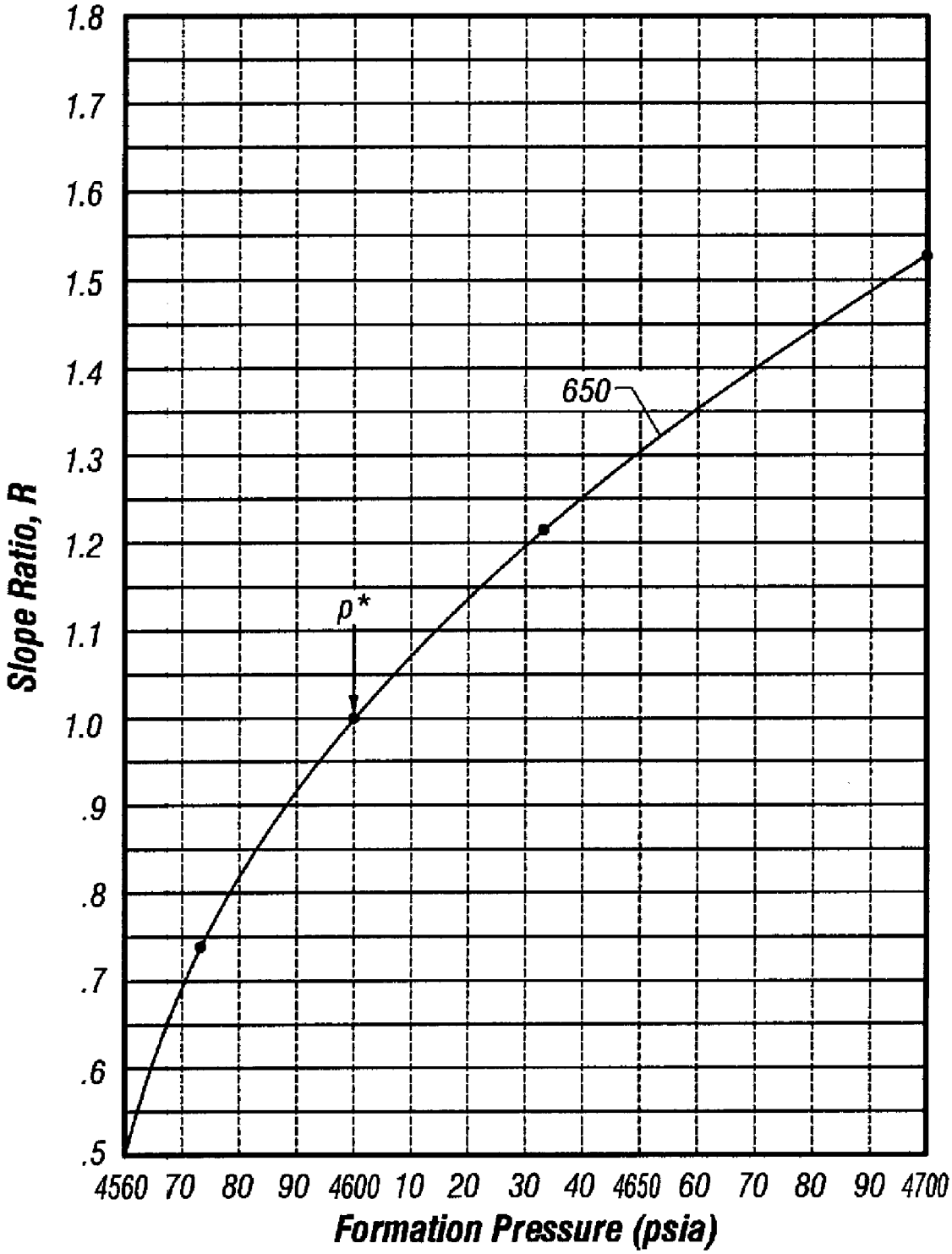
FIG. 22 is a plot graph of a method for finding formation pressure using incomplete pressure buildup data.

The procedure begins by using a MWD tool as described in FIG. 17 or a wireline tool as described in FIG. 22. A tool probe 420 is initially sealed against the borehole and the test volume 405 contains essentially only drilling fluid at the hydrostatic pressure of the annulus. Phase I 702 of the test is initiated by a command transmitted from the surface. A downhole controller 418 preferably controls subsequent actions. Using the controller to control a drawdown pump 426 that includes a drawdown piston, the pressure within the test volume is decreased at a constant rate by setting the draw rate of the drawdown piston to a predetermined rate. Sensors 424 are used to measure at least the pressure of the fluid in the tool at predetermined time intervals. The predetermined time intervals are adjusted to ensure at least two measurements can be made during each phase of the procedure. Additional advantages are gained by measuring the system volume, temperature and/or the rate of system volume change with suitable sensors. Compressibility of the fluid in the tool is determined during Phase 1 using the calculations discussed above.

Phase II of the test 704 begins when the tool pressure drops below the formation pressure p*. The slope of the pressure curve changes due to formation fluid beginning to enter the test volume. The change in slope is determined by using a downhole processor to calculate a slope from the measurements taken at two time intervals within the Phase. If the draw rate were held constant, the tool pressure would tend to stabilize at a pressure below p*.

The draw rate is increased at a predetermined time 706 to begin Phase 3 of the test. The increased draw rate reduces the pressure in the tool. As the pressure decreases, the flow rate of formation fluid into the tool increases. The tool pressure would tend to stabilize at a tool pressure lower than the pressure experienced during Phase II, because the draw rate is greater in Phase III than in Phase II. The draw rate is decreased again at a time 708 beginning Phase IV of the test when interval measurements indicate that pressure in the tool is approaching stabilization.

The draw rate may then be slowed or stopped so that pressure in the tool begins building. The curve slope changes sign when pressure begins to increase, and the change initiates Phase V 710 where the draw rate is then increased to stabilize the pressure. The stabilized pressure is indicated when pressure measurements yield zero slope. The draw down piston rate is then decreased for Phase VI 712 to allow buildup until the pressure again stabilizes. When the pressure is stabilized, the drawdown piston is stopped at Phase VII 714, and the pressure within the tool is allowed to build until the tool pressure stabilizes at the formation pressure $p_f$. The test is then complete and the controller equalizes the test volume 716 to the hydrostatic pressure of the annulus. The tool can then be retracted and moved to a new location or removed from the borehole.

Figure 10:
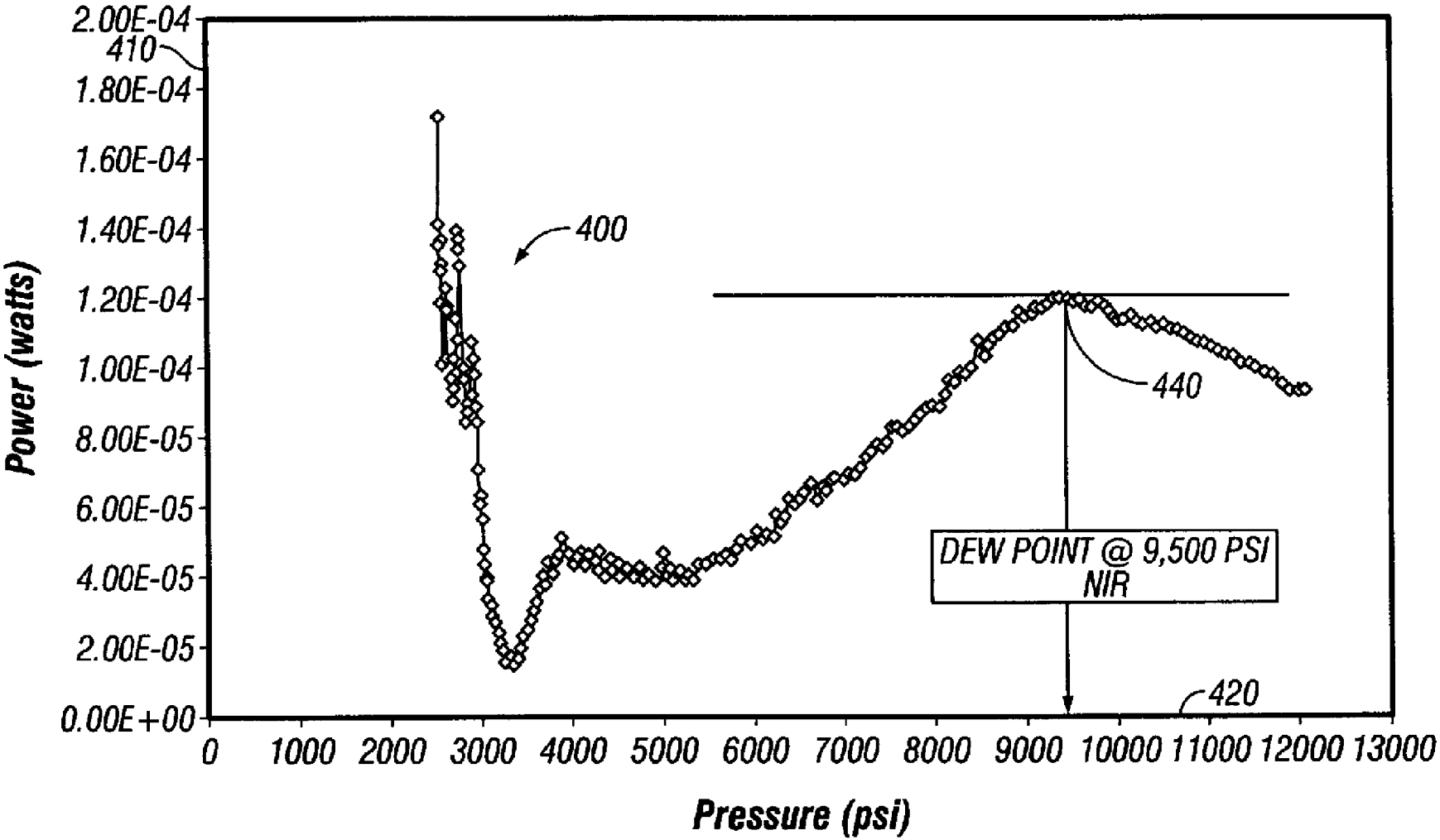
Figure 11:
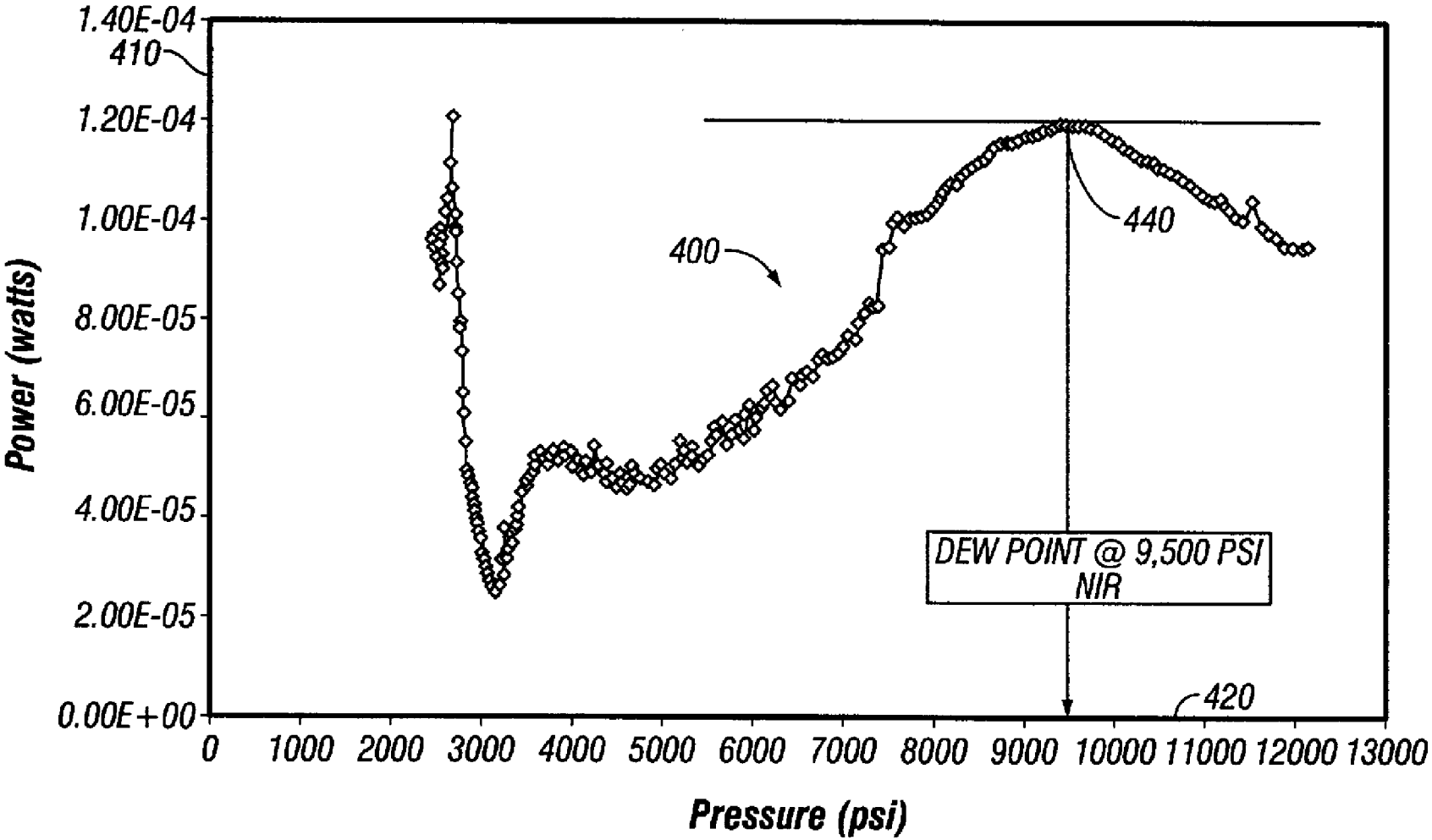

Stabilized pressures determined during Phase V 710 and Phase VI, 712 along with the corresponding piston rates, are used by the downhole processor to determine a curve as in FIG. 10. The processor calculates formation pressure p* from the measured data points. The calculated value p* is then compared to measured formation pressure $p_f$ obtained by the tool during Phase VII 714 of the test. The comparison serves to validate the measured formation pressure $p_f$ thereby eliminating the need to perform a separate validation test.

Other embodiments using one or more of the method elements discussed above are also considered within the scope of this invention. Still referring to FIG. 11, another embodiment includes Phase I through Phase IV and then Phase VII. This method is desirable with moderately permeable formations when it is desired to measure formation pressure. Typically, there would be a slight variation in the profile for Phase IV in this embodiment. Phase VII would be initiated when measurements show a substantially zero slope on the pressure curve 709. The equalizing procedure 716 would also be necessary before moving the tool.

Another embodiment of the present invention includes Phase 1702, Phase II 704, Phase VI 712, Phase VII 714 and the equalization procedure 716. This method is used in very low permeability formations or when the probe seal is lost. Phase II would not be as distinct a deviation as shown, so the straight line portion 703 of Phase I would seem to extend well below the formation pressure $p_f$.

Figure 25:
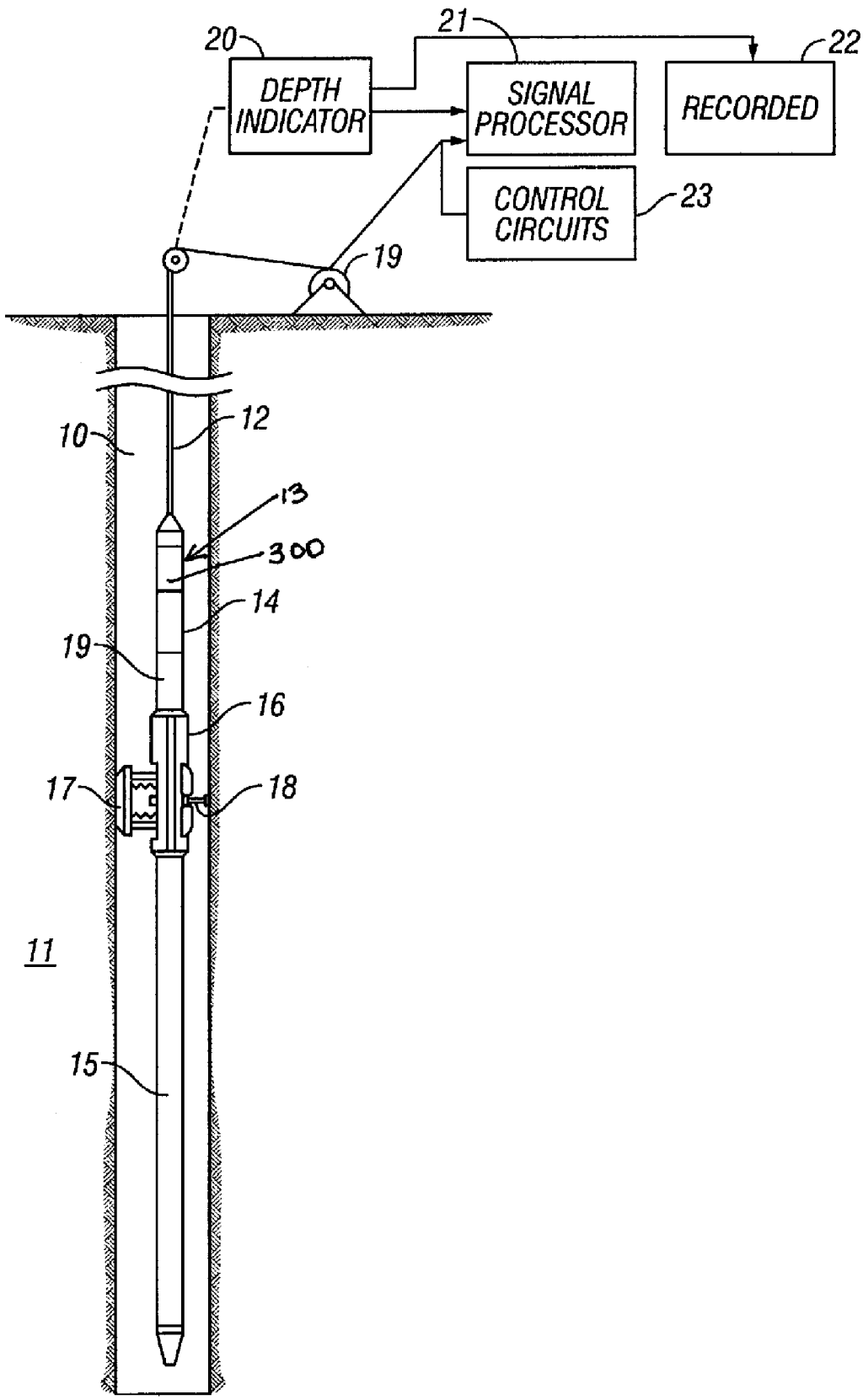
FIG. 25 is an illustration of a wire line formation sampling tool deployed in a well bore.

FIG. 25 is an illustration of a wire line formation sampling tool deployed in a well bore without packers. Turning now to FIG. 25 shows another embodiment of the present invention housed in a formation-testing instrument. FIG. 25 is an illustration of a formation-testing instrument taken from Michaels et al. U.S. Pat. No. 5,303,775 which is herein incorporated by reference in its entirety. The Michaels '775 patent teaches a method and apparatus is provided for use in connection with a downhole formation testing instrument for acquisition of a phase intact sample of connate fluid for delivery via a pressure containing sample tank to a laboratory facility. One or more fluid sample tanks contained within the instrument are pressure balanced with respect to the well bore at formation level and are filled with a connate fluid sample in such manner that during filling of the sample tanks the pressure of the connate fluid is maintained within the predetermined range above the bubble point of the fluid sample. The sample tank incorporates an internal free-floating piston which separates the sample tank into sample containing and pressure balancing chambers with the pressure balancing chamber being in communication with borehole pressure. The sample tank is provided with a cut-off valve enabling the pressure of the fluid sample to be maintained after the formation testing instrument has been retrieved from the well bore for transportation to a laboratory facility. To compensate for pressure decrease upon cooling of the sample tank and its contents, the piston pump mechanism of the instrument has the capability of increasing the pressure of the sample sufficiently above the bubble point of the sample that any pressure reduction that occurs upon cooling will not decrease the pressure of the fluid sample below its bubble point.

FIG. 25 is a pictorial illustration including a block diagram schematic which illustrates a formation testing instrument constructed in accordance with the present invention being positioned at formation level within a well bore, with its sample probe being in communication with the formation for the purpose of conducting tests and acquiring one or more connate samples. As shown in FIG. 25, a section of a borehole 10 penetrating a portion of the earth formations 11, shown in vertical section. Disposed within the borehole 10 by means of a cable or wire line 25 is a sampling and measuring instrument 13. The sampling and measuring instrument is comprised of a hydraulic power system 14, a fluid sample storage section 15 and a sampling mechanism section 16. Sampling mechanism section 16 includes selectively extensible well engaging pad member 17, a selectively extensible fluid admitting sampling probe member 18 and bi-directional pumping member 19. The pumping member 19 could also be located above the sampling probe member 18 if desired.

In operation, sampling and measuring instrument 13 is positioned within borehole 10 by winding or unwinding cable 12 from hoist 19, around which cable 12 is spooled. Depth information from depth indicator 20 is coupled to signal processor 21 and recorder 22 when instrument 13 is disposed adjacent an earth formation of interest. Electrical control signals from control circuits 23 including a processor (not shown) are transmitted through electrical conductors contained within cable 12 to instrument 13.

These electrical control signals activate an operational hydraulic pump within the hydraulic power system 14 shown, which provides hydraulic power for instrument operation and which provides hydraulic power causing the well engaging pad member 17 and the fluid admitting member 18 to move laterally from instrument 13 into engagement with the earth formation 11 and the bi-directional pumping member 19. Fluid admitting member or sampling probe 18 can then be placed in fluid communication with the earth formation 11 by means of electrical controlled signals from control circuits 23 selectively activating solenoid valves within instrument 13 for the taking of a sample of any producible connate fluids contained in the earth formation of intent. Apparatus 300 is contained in the tool.

Figure 26:
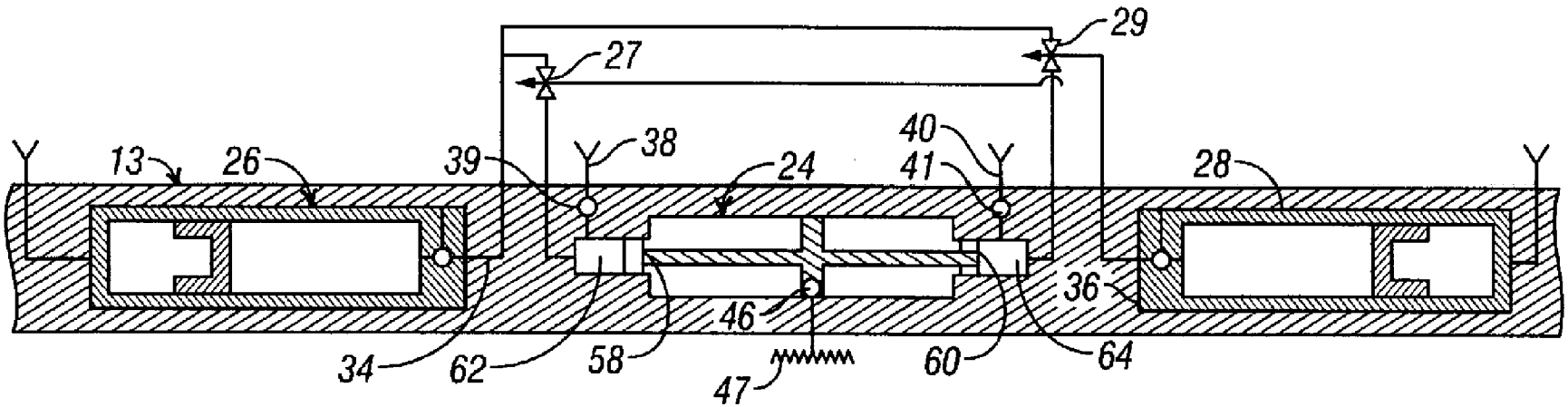
FIG. 26 is an illustration of a bi-directional formation fluid pump for pumping formation fluid into the well bore during pumping to free the sample of filtrate and pumping formation fluid into a sample tank after sample clean up.

FIG. 26 is an illustration of a bi-directional formation fluid pump for pumping formation fluid into the well bore during pumping to free the sample of filtrate and pumping formation fluid into a sample tank after sample clean up. FIG. 26 shows a portion of downhole formation multi-tester instrument which is constructed in accordance with the present invention and which illustrates schematically a piston pump and a pair of sample tanks within the instrument. FIGS. 25 and 26 are taken from Michaels et al. '775 and are described therein in detail.

As illustrated in the partial sectional and schematic view of FIG. 26, the formation testing instrument 13 of FIG. 12 is shown to incorporate therein a bi-directional piston pump mechanism shown generally at 24 which is illustrated schematically in FIG. 26. Within the instrument body 13 is also provided at least one and preferably a pair of sample tanks which are shown generally at 26 and 28 and which may be of identical construction if desired. The piston pump mechanism 24 defines a pair of opposed pumping chambers 62 and 64 which are disposed in fluid communication with the respective sample tanks via supply conduits 34 and 36. Discharge from the respective pump chambers to the supply conduit of a selected sample tank 26 or 28 is controlled by electrically energized three-way valves 27 and 29 or by any other suitable control valve arrangement enabling selective filling of the sample tanks. The respective pumping chambers are also shown to have the capability of fluid communication with the subsurface formation of interest via pump chamber supply passages 38 and 40 which are defined by the sample probe 18 of FIG. 25 and which are controlled by appropriate valving. The supply passages 38 and 40 may be provided with check valves 39 and 41 to permit overpressure of the fluid being pumped from the chambers 62 and 64 if desired. LMP 47 tracks the position and speed of pistons 58 and 60 from which pumping volume, over time, for a known piston cylinder size can be determined.

The present example of the invention runs FRA at the end of each pumping piston stroke on the suction side of the pump while the formation is building up to determine mobility, compressibility and correlation coefficient. The present invention provides a plot of mobility versus time as a deliverable to a sampling client as an indication of confidence of the integrity of the sample. The FRA plots pressure versus formation flow rate as shown in FIG. 29. The closer the plot is to a straight line, the higher the correlation coefficient. A correlation coefficient of above 0.8 indicates that the pumping rate is well matched to the formation's ability to produce formation fluid.

The plot of pressure as a function of time yields the formation pressure, P* as a result of solving the equation P(t)=P*−[reciprocal of mobility]×[formation flow rate]. The slope of this plot is negative and the y intercept is P* with P on the vertical axis. The reciprocal of the plot is the mobility. The degree to which the plot matches a straight line is the correlation coefficient. When the correlation coefficient falls below 0.8, a problem is indicated. The present invention will give an up arrow indication to the operator to increase pump speed when the formation is capable of delivering single-phase formation fluid at a faster pumping speed and a down arrow to decrease pump speed when the pumping speed exceeds the formation's ability to deliver single-phase formation fluid at the existing pumping speed.

The pump volumes of chambers 62 and 64 are known and the position and rate of movement for the pistons 58 and 60 are known from LMP 47 so that FRA is performed on the bi-directional pump at the end of each pump stroke. As the draw down rate and pump volumes are known by the position of the piston and rate of change of position and the dimensions of the chamber 62 and 64, the draw down volume is also known or can be calculated.

$P_{saturation}-P^*=-(1/\text{mobility})(\text{formation rate})$. $P_{saturation}-P^*$ represents the window of tolerance of the sample before going into two-phase. Using FRA, formation fluid mobility is determined so that the formation flow rate is calculated and appropriate pumping rate $q_{dd}$ in equation 16 is calculated to match the formation flow rate as discussed below. The controller in the tool adjusts the pumping rate automatically by sending feedback signals to the hydraulic controller valving at the pump or sends a signal to the operator to adjust the pump rate to achieve optimal pumping rate to match the formation mobility.

During pumping when the bi-directional pump piston 58, 60 reaches the end of a pumping stroke, FRA is applied to the suction side of the pump. Before the pump piston 58, 60 moves, FRA uses formation build up at the end of each pump stroke to determine compressibility, mobility and a correlation coefficient for the formation fluid being pumped. Thus FRA during pumping provided by the present invention enables obtaining a correct draw down volume and draw down rate during single phase sampling using LMP data and pump dimensions. FRA data for mobility, compressibility, and FRA plots pressure gradients validate the sampling data and pressure test data. Thus, FRA while pumping ensures that the proper draw down rate is used to perform an accurate pressure test and obtain a single phase sample representative of the formation.

In accordance with the current exemplary embodiment, the present invention provides an apparatus and method for monitoring the pumping formation fluids from a hydrocarbon bearing formation and providing quality control for the pumping through the use of the FRA techniques described above applied after each pump stroke. FRA is applied to the suction side of the pump while monitoring formation build up using FRA to calculate mobility, compressibility, correlation coefficient and P* versus time in accordance with the present invention. The present embodiment is a method that analyzes a wire line formation tester tool measurement data for formation pressure and formation fluid mobility by applying the FRA techniques described above at the end of each pump stroke of the bidirectional pump shown in FIG. 26. Formation testing tools typically perform pump out or pump through of formation fluid from the formation into the well bore in order to clean the mud filtrate prior to taking formation fluid samples. The pumping can last for hours in an attempt to obtain formation fluid free of filtrate (cleaned-up). Moreover, maintaining the pumping speed in the most efficient manner without encountering problems such as tool plugging, packer leakage, sanding or formation failure is a critical issue. The present invention applies FRA to pumping data using the known pump volume of the bi-directional pumping chamber 62 or 64. In a exemplary embodiment the processor provided in the downhole tool informs the operator as to desired pumping speeds whether to increase or decrease pumping speed by displaying an up or down arrow to the operator at the surface and stoppage or automatically adjusts the pumping speed.

The FRA correlation coefficient for a series of continuous pump strokes will be relatively high, i.e., above 0.8-0.9 when the pumping activities are free of problems, but the FRA correlation coefficient will deteriorate and become low again when problems are encountered in the pumping process. The FRA compressibility is used as an indicator for fluid type change during the pumping. With continuous monitoring of the formation fluid compressibility, a change in the type of fluid being pumped from the formation is quickly detected. Thus, when there is a significant difference between mud filtrate compressibility and the formation fluid compressibility, it is relatively easy to monitor formation clean-up as the compressibility changes from a value indicative of mud filtrate to a value indicative of formation fluid. Monitoring near infrared spectral optical density measurements are combined with FRA compressibility to determine formation sample clean up.

The present invention utilizes FRA on a known pump volume for the bi-directional pump chambers 62 and 64 or a single direction pump chamber. The FRA technique can be applied to a single pump stroke or several pump strokes together and the mobility, compressibility, and the correlation coefficient will be calculated for the stroke or strokes. Using the FRA determined formation mobility the present invention calculates the optimal pumping speed to maintain the flowing pressure above the saturation pressure and notifies the tool engineer if a change in pumping parameters is needed to attain the optimal pressure or automatically adjusts the pumping speed to attain the optimal pressure where the pumping speed pressure is matched with the formation's ability to produce. The present invention continuously monitors the FRA mobility, compressibility, and the correlation coefficient during the pumping process to observe significant changes in the FRA mobility, compressibility, and the correlation coefficient to determine the formation's ability to produce or detect problems during pumping.

The FRA technique enables calculation of the formation rate for analysis. The following equation (16) is the basis for the analysis:

$$p(t)=p^*-(\mu/(kG_0r_i))(C_{sys}V_{sys}(dp(t)/dt)+q_{dd}). \quad (16)$$

The entire term, $C_{sys}$ $V_{sys}$ (dp(t)/dt)+$q_{dd}$, in the second parenthesis on the right side of the equation is the formation rate that is calculated by correcting the piston rate ($q_{dd}$) for tool storage effects. $C_{sys}$ is the compressibility of the fluid in the tool flow line and $V_{sys}$ is the volume of the flow line. $G_0$ is the geometric factor and $r_i$ is the probe radius.

The LMP pumping piston position indicator potentiometer 47 is shown in FIG. 26. The LMP is useful in tracking both piston position and piston movement rate and a curve for linear volume displacement of the pumping piston or sample chamber piston to determine pumping volume. The draw down volume (DDV) and pumping volume (PTV) are calculated from this curve using the pumping piston cross sectional area in cm; Pump (PTV−BB) volume curve is in $cm^3$. FRA is applicable to the pumping with small volume 56 cc pump when the pump volume is reported in the pumping volume (PTV) curve.

Mobility and compressibility changes for each pump stroke, but are very close. Mobility increases only slightly. The FRA for three pumping strokes as combined generates a de facto average of sorts over three pumping strokes for compressibility and mobility. The above example indicates the FRA can be successfully applied to pumping data when the Reservation Characterization Instrument (RCI) 56 cc (BB) pump is used and pumping volume (PTV) curves are turned on. FRA is applied to each stroke or can be applied to several strokes together in order to save computation time.

The saturation pressure of the formation fluid or mixture of formation fluid and filtrate can be estimated through downhole expansion tests, or it can be estimated from a known data base data of correlated values. Once the formation mobility is obtained from FRA, the maximum pump rate that can still maintain flowing pressure above the saturation pressure is calculated using FRA. Also any significant change, e.g., one-half or one order of magnitude in FRA compressibility implies change in the fluid type flowing into the tool, which will be an indicator for formation clean up.

The present invention selects a portion of total draw down pump strokes and builds FRA data based on the calculated draw down rate. With the pumping data, an analysis interval is selected based on the number of pump strokes instead of draw down rate. The present invention uses a variable number of strokes through out the pumping, choosing a small pump strokes at the beginning, e.g., two or three pump strokes, and progressively increasing the number of pump strokes up to a selectable fixed maximum strokes, e.g., 10 strokes, or in the present example, approximately 500 cc of pumped fluid.

Figure 27:
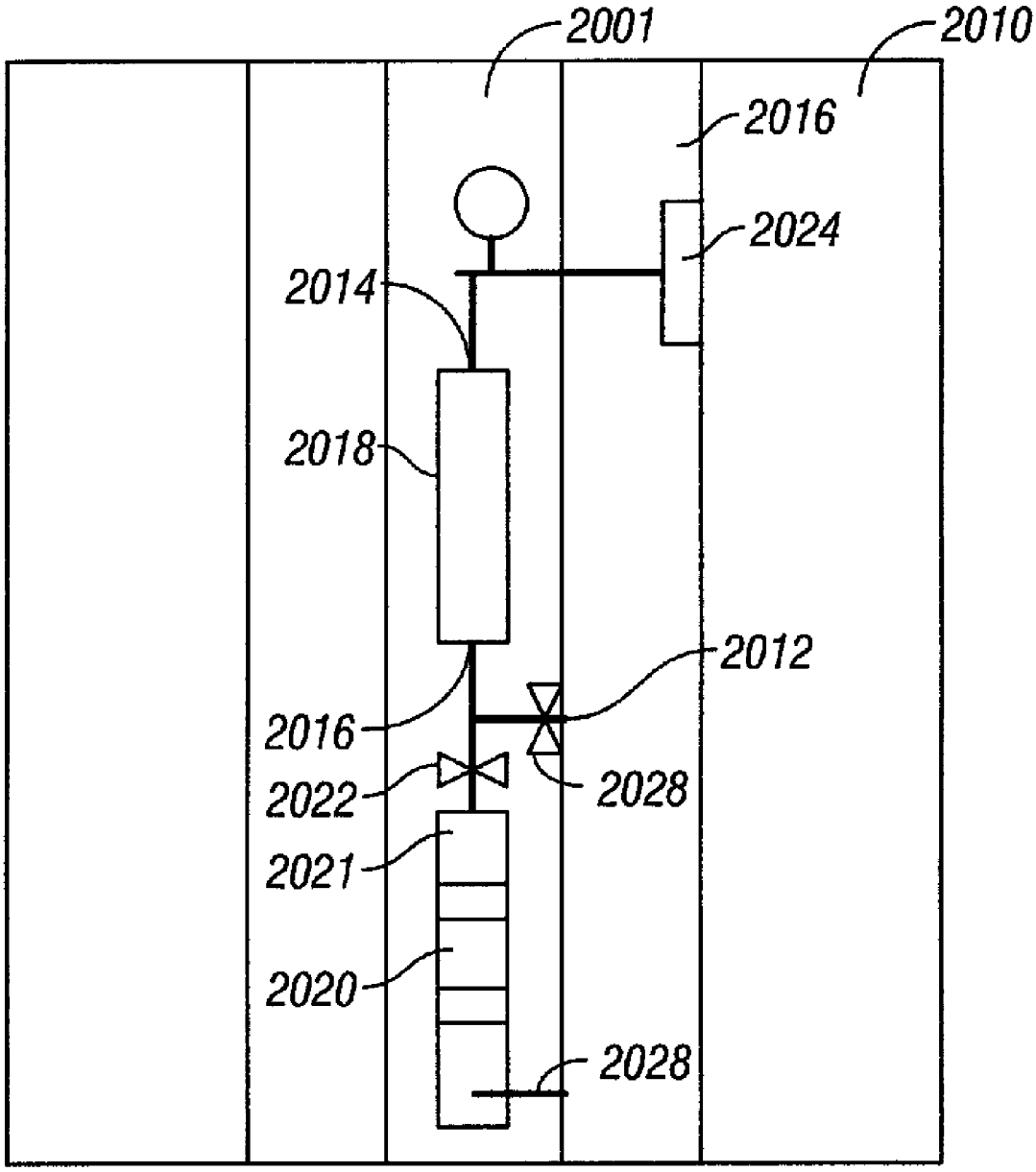
FIG. 27 is an illustration of a sampling tool where by a quality sample is pumped from a formation while measuring mobility/permeability versus time to ensure a single phase sample with low filtrate contamination, the sample having the same physical characteristics as it did when the sample existed in a formation.

Turning now to FIG. 27, an illustration of a sampling tool is presented. The present invention enables FRA during pumping of a sample from a formation. The FRA enables calculation of compressibility, permeability and mobility versus time. The monitoring of the permeability versus time enables an estimate or determination of the degree of filtrate contamination in the sample. As the compressibility of formation fluid is greater than the compressibility of filtrate, thus the compressibility steadily declines and levels off asymptotically to a steady state value as the formation sample is cleaned up and rid of filtrate during pumping of the formation fluid sample form the formation.

As shown in FIG. 27, pump 2018 pumps formation fluid from formation 2010. The formation fluid from the formation 2010 is directed either to the borehole exit 2012 during sample cleanup or to single phase sample tank 2020 and captured as sample 2021 once it is determined that the formation sample is cleaned up. The present invention enables monitoring of compressibility, permeability and mobility versus time in real time to enable quality control of the sample so that the sample remains in the same state as it existed in the formation.

The suction side 2014 of the pump 2018 drops below formation pressure to enable flow of the formation fluid from the formation into the pump 2018. The amount of pressure drop below formation pressure on the suction side of the pump is set by the present invention. The amount of the pressure drop is set so that the sample pressure does not go below the bubble point pressure or dew point. The amount of the pressure drop on the suction side is also set so that the pressure does not drop below the pressure at which asphaltenes do not precipitate out of the sample, thereby ensuring that the sample stays in the liquid form in which it existed in the formation. Thus, a first pressure drop is set so that the pressure drop during pumping does not go below the bubble point pressure and gas bubbles are formed. A second pressure drop is set so that the pressure drop during pumping does not go below the pressure at which solids such as asphaltenes precipitate from the formation fluid. Thus, the provision of the first and second pressure drops ensures delivery of a formation fluid sample without a change in state of additional gas or solid. The first and second pressure drops values are determined by the bubble point pressure and solids precipitation pressures provided by modeling or prior data analysis for the formation. The monitoring of the sample filtrate cleanup ensures that the formation fluid sample does not contain filtrate, or contains a minimum amount of filtrate so that the composition formation fluid sample is representative of the composition of the formation fluid as it exists in the formation.

In another embodiment, the method of the present invention is implemented as a set computer executable of instructions on a computer readable medium, comprising ROM, RAM, CD ROM, Flash or any other computer readable medium, now known or unknown that when executed cause a computer to implement the method of the present invention.

While the foregoing disclosure is directed to the exemplary embodiments of the invention various modifications will be apparent to those skilled in the art. It is intended that all variations within the scope of the appended claims be embraced by the foregoing disclosure. Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

What is claimed is:

1. A computer readable medium for use with an apparatus configured to sample a formation fluid, the apparatus comprising:

a fluid conduit configured to receive a fluid sample from the formation;

a pump configured to pump the fluid sample through the fluid conduit;

a pressure measurement device configured to measure the pressure in the fluid sample in the fluid conduit;

the medium comprising instructions that enable a computer to determine a pumping rate for the formation fluid sample using the pressure on the fluid sample in the fluid conduit and a measured value of an electromagnetic energy passing through the fluid sample in the fluid conduit to determine at least one reference pressure value for setting the pumping rate for the pump.

2. The medium of claim 1, further comprising:

determining an optimal pumping rate based on the pressure at peak power.

3. The medium of claim 1, further comprising:

determining a dew point pressure for the sample.

4. The medium of claim 3, further comprising:

determining an optimal pumping rate based on the dew point pressure.

5. The medium of claim 1, further comprising:

determining a bubble point pressure for the sample.

6. The medium of claim 5, further comprising:

determining an optimal pumping rate based on the bubble point pressure.

7. The medium of claim 1, further comprising:

determining an asphaltene precipitation pressure for the sample.

8. The medium of claim 7, further comprising:

determining an optimal pumping rate based on the asphaltene precipitation pressure.

* * * * *